US006874331B2

(12) United States Patent
Chandler et al.

(10) Patent No.: US 6,874,331 B2
(45) Date of Patent: Apr. 5, 2005

(54) DEVICE AND METHOD FOR CREATING A HORIZONTAL AIR CURTAIN FOR A COOLER

(75) Inventors: Michael S. Chandler, Bath Springs, TN (US); Larry R. Scallion, Parson, TN (US)

(73) Assignee: Manitowoc Foodservice Companies, Inc., Sparks, NV (US)

( * ) Notice: Subject to any disclaimer, the term of this patent is extended or adjusted under 35 U.S.C. 154(b) by 0 days.

(21) Appl. No.: 10/440,513

(22) Filed: May 16, 2003

(65) Prior Publication Data

US 2004/0003617 A1 Jan. 8, 2004

Related U.S. Application Data

(60) Provisional application No. 60/381,304, filed on May 17, 2002.

(51) Int. Cl.[7] ..... A47F 3/04

(52) U.S. Cl. ..... 62/256; 62/408; 454/193

(58) Field of Search ..... 62/256, 408, 419, 62/426; 454/188, 193

(56) References Cited

U.S. PATENT DOCUMENTS

| | | | | | |
|---|---|---|---|---|---|
| 2,516,432 | A | | 7/1950 | Spencer | 98/36 |
| 3,218,952 | A | | 11/1965 | Gygax | 98/36 |
| 3,270,655 | A | | 9/1966 | Guirl et al. | 98/36 |
| 3,308,740 | A | | 3/1967 | Henson et al. | 98/36 |
| 3,331,303 | A | | 7/1967 | Gladd et al. | 98/36 |
| 3,350,994 | A | * | 11/1967 | Guibert | 454/190 |
| 3,608,468 | A | * | 9/1971 | McClurkin | 454/192 |
| 3,817,160 | A | * | 6/1974 | Searcy et al. | 454/188 |
| 3,859,900 | A | * | 1/1975 | Fordsmand | 454/190 |
| 3,998,142 | A | | 12/1976 | Foreman et al. | 98/36 |
| 4,074,620 | A | * | 2/1978 | Jansson | 454/190 |
| 4,261,519 | A | | 4/1981 | Ester | 239/548 |
| 4,379,391 | A | * | 4/1983 | Rhee | 62/408 |
| 5,133,246 | A | * | 7/1992 | Campbell | 454/52 |
| 5,284,023 | A | | 2/1994 | Silva et al. | 62/77 |
| 5,809,799 | A | * | 9/1998 | Jeon | 62/408 |
| 6,038,880 | A | * | 3/2000 | Oh | 62/408 |
| 6,105,377 | A | | 8/2000 | Jeong et al. | 62/180 |
| 6,351,964 | B1 | | 3/2002 | Brancheau et al. | 62/249 |

FOREIGN PATENT DOCUMENTS

DE 100 18 895 * 10/2001

OTHER PUBLICATIONS

"Enviro®", Product data sheets for ASI Technologies, Inc. AirSeal™ Air Door Model–715, pp. 1–4, Sep. 2000.

"The Door is Invisible. The Benefits Are Not.", Product information sheets for ASI Technologies, Inc. enviro Cold Storage Door Systems, pp. 1–4, undated but prior to May 16, 2003.

"ASI Technologies, Inc. High Performance Door Solutions", Product information sheets for Marathon™ , CleanSeal™ , and enviro® doors, pp. 1–4, undated but prior to May 16, 2003.

"Enviro® Cold Storage Doors", Product Selection Guide, pp. 1–4, © 2000, ASI Technologies, Inc.

"Enviro® cold storage doors", Product data sheets, ASI Technologies, Inc., pp. 1–13, 1993.

* cited by examiner

*Primary Examiner*—William E. Tapolcai
(74) *Attorney, Agent, or Firm*—Steven P. Shurtz; Brinks Hofer Gilson & Lione

(57) ABSTRACT

An apparatus for creating a horizontal air curtain for a cooler doorway has at least one air moving device; at least one motor powering the air moving device; a control system including a sensor, the control system providing power to operate the motor when the sensor detects that the door of the cooler is open; and at least one air discharge nozzle mounted adjacent to the air moving device directing air emitted by the air moving device to create a curtain of air that flows generally horizontally across at least a portion of the doorway.

75 Claims, 14 Drawing Sheets

115/1/60
WIRE TO LIGHT FIXTURE IN DOOR JAMB
H N G
FIELD WIRING
31
23
33
22
22
28
29
28
28
29
28

DEVICE AND METHOD FOR CREATING A HORIZONTAL AIR CURTAIN FOR A COOLER

REFERENCE TO EARLIER FILED APPLICATION

This application claims the benefit under 35 U.S.C. § 119(e) of the filing date of Provisional U.S. patent application Ser. No. 60/381,304, filed May 17, 2002, which is hereby incorporated by reference.

BACKGROUND OF THE INVENTION

Coolers are widely used. A myriad of applications call for maintaining temperatures at a reduced level. Some examples include food processing plants, dairies, bakeries, bottling plants, restaurants, supermarkets, hospitals, and school cafeterias. In the medical setting, coolers are used to maintain the temperature of test samples and medications. In the restaurant business, coolers are used to keep food items, beverages etc. at certain temperatures. The refrigerated compartment of such coolers may be kept below 32° F. Hence, coolers are often referred to as refrigerator or freezers. In commercial settings, coolers are often large enough for a person to walk into. The contents of the cooler are frequently accessed, hence the doors of the coolers are opened frequently.

Every time the cooler door is opened, not only does a draft of cool air escape out of the cooler via the cooler's doorway, but a draft of warm air also enters the cooler. This infiltration of ambient warm air into the refrigerated compartment while the cooler door is open invariably results in raising the interior temperature of the refrigerated compartment of the cooler. This may overload the refrigeration system used to keep the temperature at a desired set point, and ultimately results in the refrigeration system consuming more power to maintain the internal cooler temperature. Furthermore, the food industry has a keen interest in controlling the damaging effect of losing cool air, because food will start to spoil if the temperature inside the cooler is not maintained at the proper temperature.

Keeping the door closed is one way to avoid air infiltration. But opening the door is inevitable. Hence a solution is needed for retaining the cool air within the cooler.

An air curtain is a device that provides a barrier that reduces the airflow through an open refrigerator or freezer doorway, yet at the same time allows a person to pass through the doorway. The air curtain is a layer or curtain of air that is formed by a blower emitting a stream of air. Air curtains became increasingly popular in Europe throughout the late 1940's and 1950's. The reason for the wide spread use and popularity of air curtains lies in the array of advantages offered by the air curtain. The air curtain aids in maintaining the cooler's temperature by retaining the cool air within the refrigerated compartment, hence reducing the energy costs.

The air curtain serves a twofold purpose of retaining the cooler air within the cooler and reducing the amount of warm air that enters through the cooler's open door. It must be noted that the air curtain does not completely prevent cold air from escaping and warm air from entering via an open door. However, the air curtain reduces the amount of cold air that escapes the cooler and the amount of warm air entering the cooler.

Conventional air curtains are sized to cover the entire doorway area, and generally have a vertical flow of air. Air curtains are also available in different forms, such as continuously running air curtains, temperature activated air curtains, and air curtains equipped with a control panel that allows the user to preset a configuration of the control parameters of the air curtain such as humidity, air speed and velocity etc.

One problem with prior art air curtain devices is that they are neither effective nor efficient when used for applications such as walk-in coolers. If the power consumed by the device that generates the air curtain is greater than the savings in power consumption due to inhibited air flow through an open doorway, the air curtain device is not worth using. Also, if the initial cost of the device is too high, the cost savings from the power savings over the life of the device may not pay for the device. Another problem is that many air curtain devices are large or bulky, and take up precious space inside the cooler, particularly with ductwork. Many times there is not room to install an overhead air curtain on either the inside or outside of a walk-in cooler. Many prior art air curtain devices have adjustable nozzle directions and fan speeds. However, most people cannot make proper adjustment to achieve satisfactory results.

Thus there is a need for an air curtain device that can be used for walk-in coolers and that is fairly inexpensive to build, is compact and decreases the total power consumption of the cooler, taking into account the added power consumption of the air curtain device. It is preferably if such a device does not need the user to make adjustments.

BRIEF SUMMARY OF THE INVENTION

An economical, effective and efficient air curtain device has been invented. In a first aspect, the invention is an apparatus for creating an air curtain for a cooler having a refrigerated compartment, the apparatus comprising at least one air moving device drawing air in from the refrigerated compartment and emitting that air; at least one motor powering the air moving device; a control system including a sensor detecting whether a door of the cooler is open, the control system providing power to operate the motor when the sensor detects that the door of the cooler is open; and one or more air discharge nozzles directing air emitted by the at least one air moving device to create a curtain of air that flows horizontally across at least a portion of a doorway of the cooler normally closed by said door, the one or more nozzles being configured to be mounted adjacent to a doorway of the cooler such that air is discharged at an angle of at least 5° in relation to a plane of the doorway.

In a second aspect, the invention is a method of operating a cooler having insulated walls defining a refrigerated compartment, a doorway in one of the walls having a normally closed door, and a refrigeration system cooling the cooler, the method comprising the steps of: starting a motor powering one or more blowers in conjunction with the door being opened; the one or more blowers drawing air from the refrigerated compartment and emitting the air via one or more nozzles to produce a horizontal air curtain when the motor drives the one or more blowers, the one or more nozzles discharging the air at an angle of at least 5° in relation to a plane of the doorway; and stopping the motor by cutting off power to the motor in conjunction with the door being closed.

In a third aspect, the invention is a cooler having a refrigerated compartment defined by insulated walls, a doorway in one of the walls and a door normally closing the doorway, the cooler also comprising an air curtain device comprising: one or more blowers drawing air from the refrigerated compartment and emitting that air; one or more motors powering the one or more blowers; a control system comprising a sensor detecting whether the door of the cooler is open, the control system providing power to operate the one or more motors when the sensor detects that the door is open; and one or more air discharge nozzles directing air from the one or more blowers to form a curtain of air that flows horizontally across at least a portion of the doorway only when the door is open and at an angle of at least 5° in relation to a plane of the doorway.

In a fourth aspect, the invention is a compact apparatus for creating a horizontal air curtain for a doorway of a cooler comprising: at least one blower; at least one motor powering the blower; at least one air discharge nozzle; the at least one motor and blower being vertically mounted together in a stacked manner; a sensor detecting whether a door of the cooler is open; and a control system that provides power to operate the motor when the sensor detects a door-open condition.

In a fifth aspect, the invention is a method of designing an energy efficient cooler comprising: identifying parameters specific to a given cooler design that have a bearing on the characteristics of a horizontal air curtain that will economically inhibit cold air from leaving the cooler when a door to the cooler is open; and selecting a blower and an air discharge nozzle, and configuring the blower and nozzle such that i) the volume of air emitted by the blower, ii) the angle of the air discharge nozzle compared to plane of a doorway of the cooler and iii) the velocity of an air stream emitted from the air discharge nozzle are selected to minimize power consumption required to operate the combined cooler and air curtain.

In a sixth aspect, the invention is a method of conserving energy during operation of a walk-in cooler comprising the steps of: providing a walk-in cooler having a refrigeration system and insulated walls with a doorway in one of the walls and a door normally closing the doorway with a horizontal air curtain apparatus, the air curtain apparatus comprising i) at least one air moving deice; ii) at least one motor powering the air moving device; iii) a control system that detects when the door is open and provides power to operate the at least one motor only when the door is open; and iv) one or more air discharge nozzles directing air emitted by the at least one air moving device to create a curtain of air that flows horizontally across at least a portion of the doorway; and operating the air curtain apparatus such that the energy consumed to create the air curtain is less than the energy saved as the refrigeration system has to do less work because air flow in and out of the doorway is inhibited by the air curtain when the door is open.

When the door is opened, in the preferred air curtain device, an air curtain activation switch is released and automatically activates the air curtain instantaneously. The air curtain is activated and ramps up to speed quickly, since the fan emitting air forming the air curtain runs at full speed almost immediately upon opening the cooler door.

The present invention and its advantages will be best understood in view of the accompanying drawings.

DETAILED DESCRIPTION OF THE DRAWINGS AND PREFERRED EMBODIMENTS OF THE INVENTION

As used herein, the term "cooler" refers to walk-in as well as reach-in refrigerated compartments, which can be maintained at refrigerated or freezing temperatures.

Figure 1:
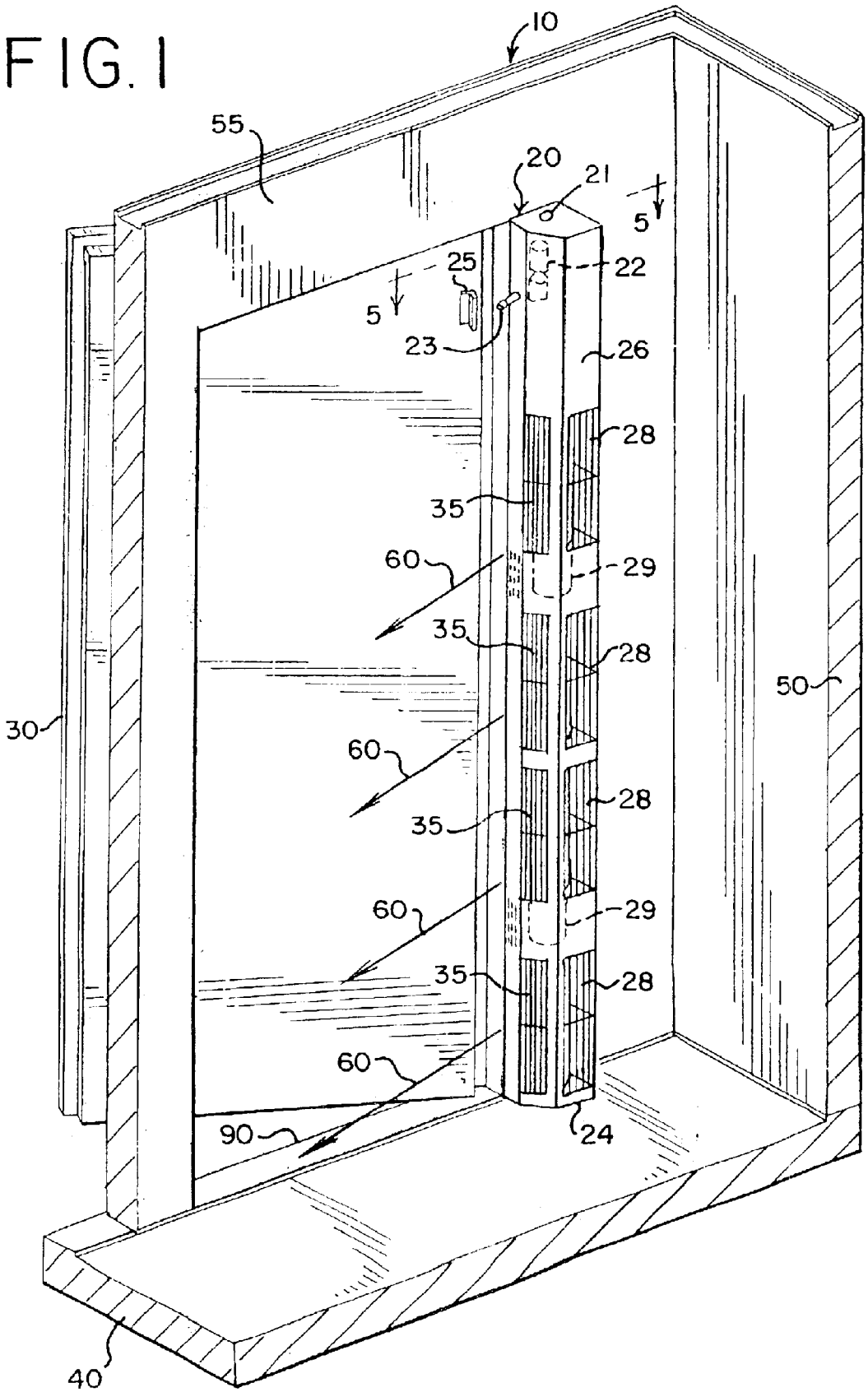
FIG. 1 is a partial sectional and perspective view of an air curtain device positioned adjacent a door inside of a walk-in cooler.
Figure 2:
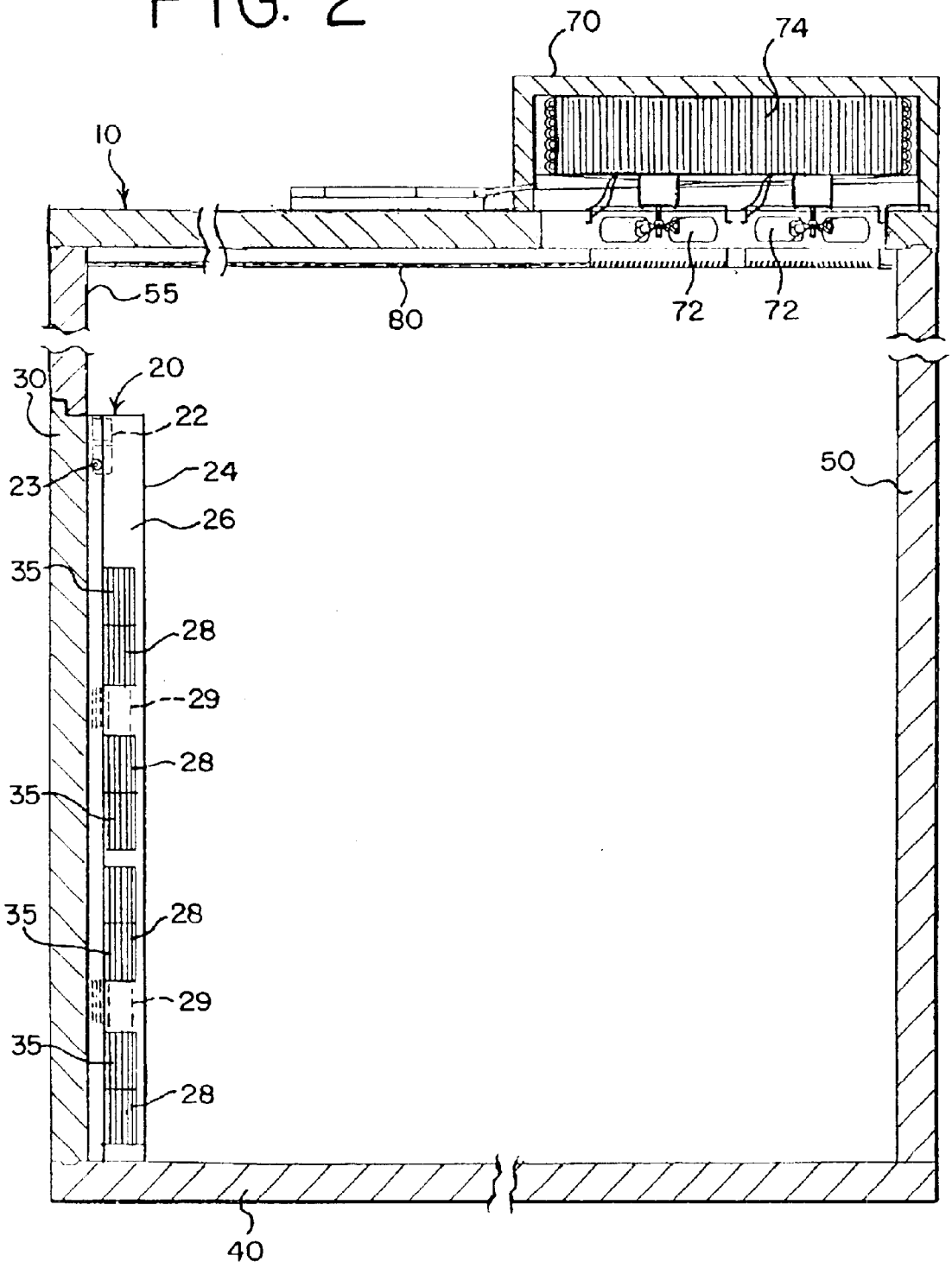
FIG. 2 is a cross-sectional view of the cooler of FIG. 1 taken along a vertical plane perpendicular to and bisecting the door.
Figure 3:
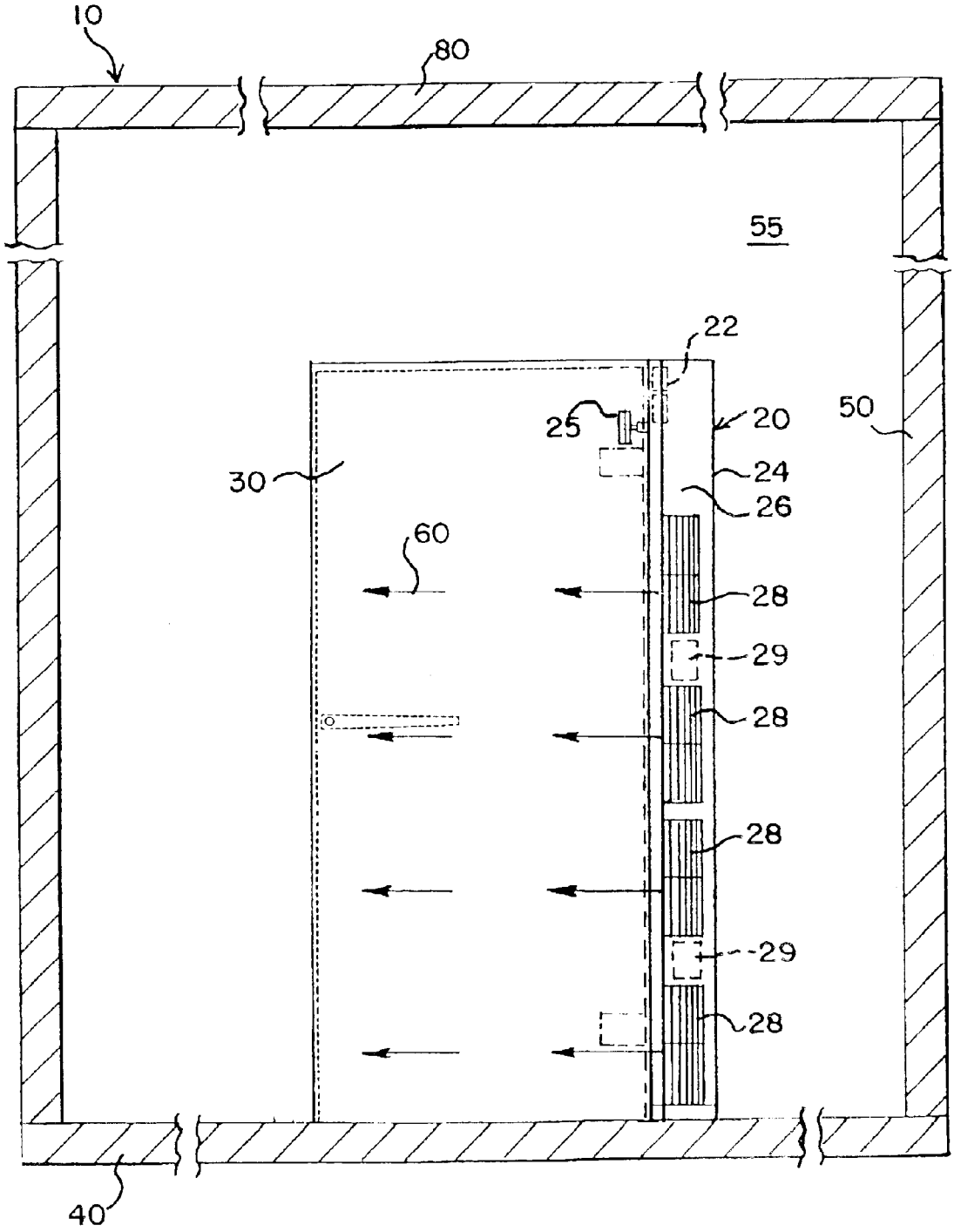
FIG. 3 is a cross-sectional view of the cooler of FIG. 1 taken along a plane parallel to the door.

A first preferred embodiment of the present invention, shown in FIGS. 1–6, includes an air curtain device 20 inside of a cooler 10. The cooler 10 is preferably a walk-in cooler. The cooler has insulated walls 50, which help in maintaining the interior temperature of the cooler 10. The cooler 10 also has an insulated floor 40 and ceiling 80 as shown in FIG. 2 and FIG. 3. The cooler 10 has doorway 90, normally closed by door 30. The air curtain device 20 is vertically mounted inside the cooler 10 and along the hinge side of the door 30. Cooling unit 70 is mounted on the ceiling 80 as shown in FIG. 2. The cooling unit 70 is a conventional cooling unit, which has a compressor (not shown), a condenser (not shown), evaporator coils 74 and fans 72 for circulating air past the evaporator coils 74.

The cooling unit 70 performs the cooling operation for cooler 10. The cooling unit 70 usually is located on the ceiling at the back right corner of the cooler 10. The commonly used cooling unit has some components that hang down inside the refrigerated compartment of the cooler. In the first preferred embodiment, the functioning of the cooling unit 70 is independent of the functioning of the air curtain device 20. More specifically, the air curtain device is activated upon opening of the door 30, regardless of whether the cooling unit is running or not. Furthermore, the cooling unit operates based on a thermostat as in typical walk-in coolers. The cooling unit may be sized and configured to make the cooler 10 a walk-in freezer or a walk-in refrigerator.

Figure 4:
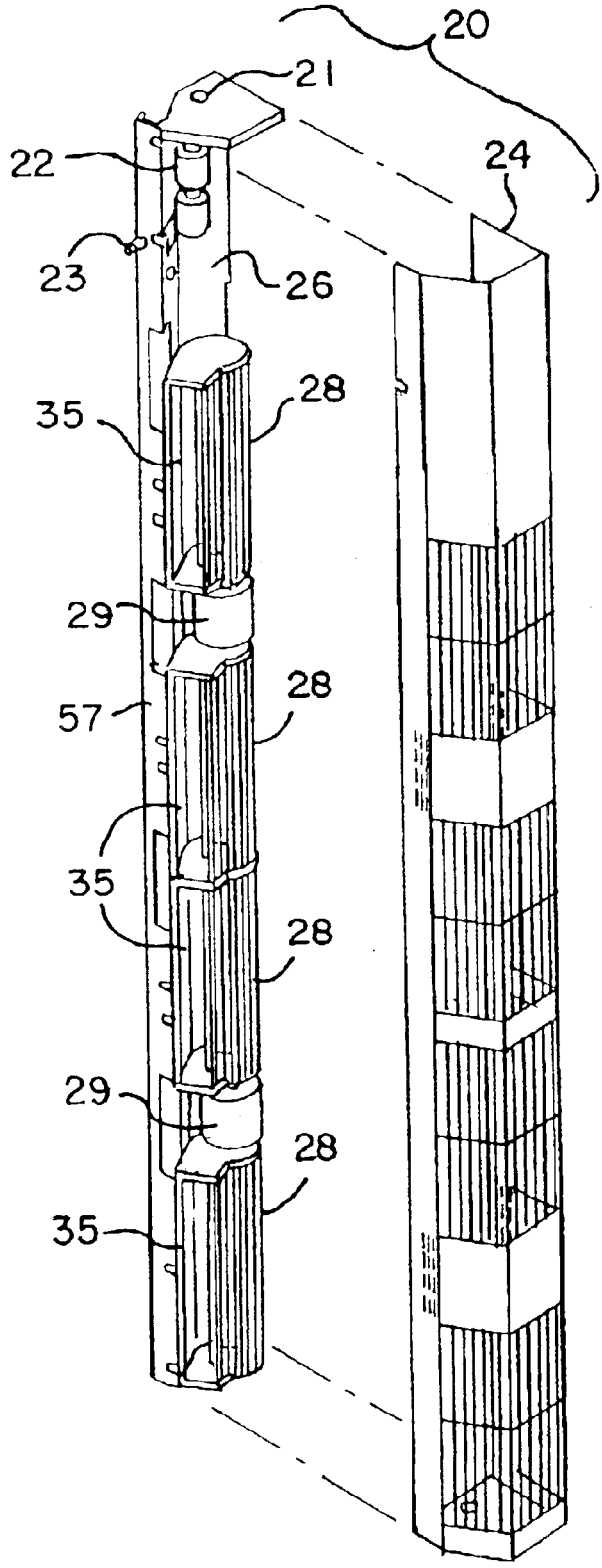
FIG. 4 is an exploded view of the air curtain device used in the embodiments of FIG. 1.
Figure 5:
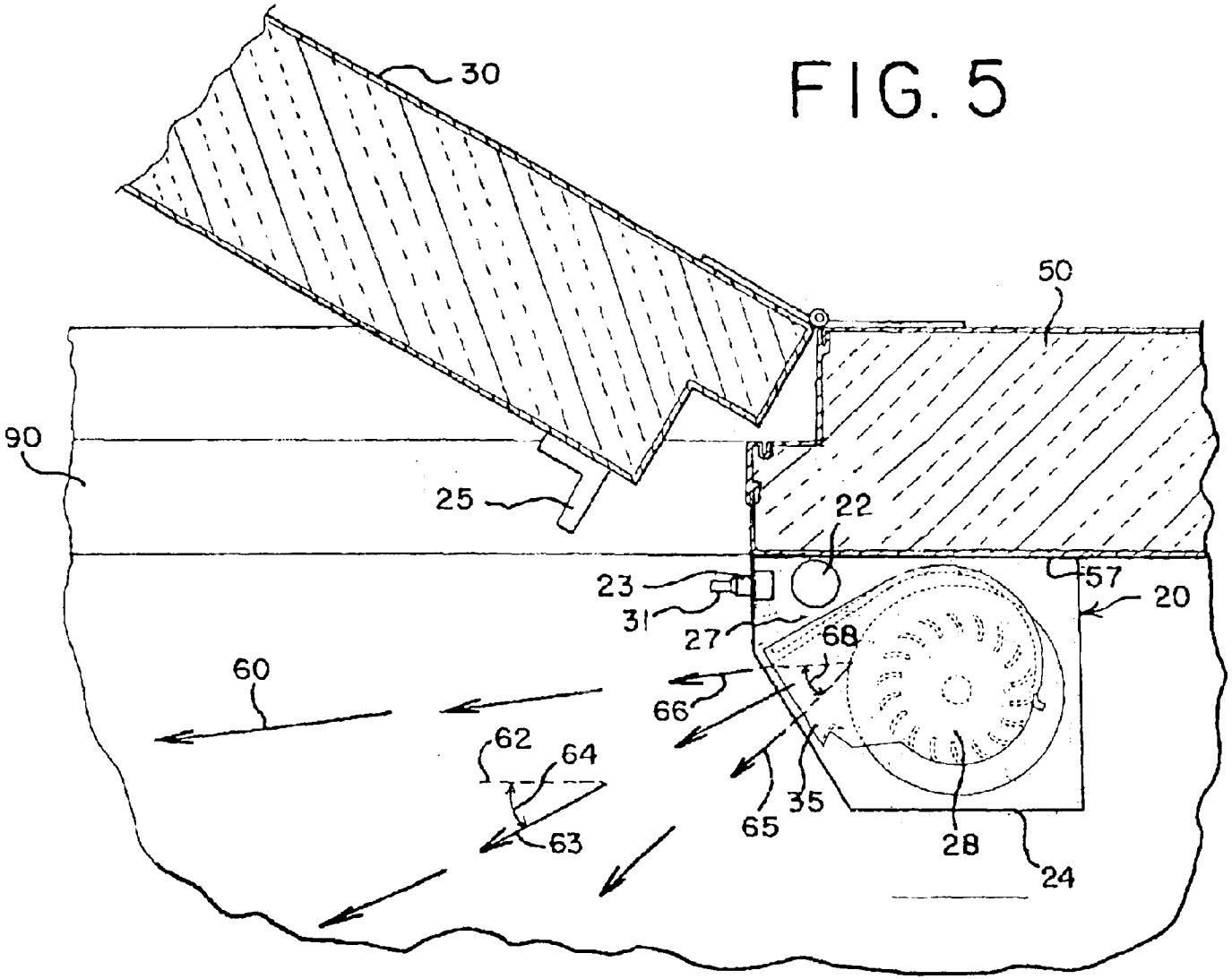
FIG. 5 is a cross-sectional view taken along line 5—5 of FIG. 1.
Figure 6:
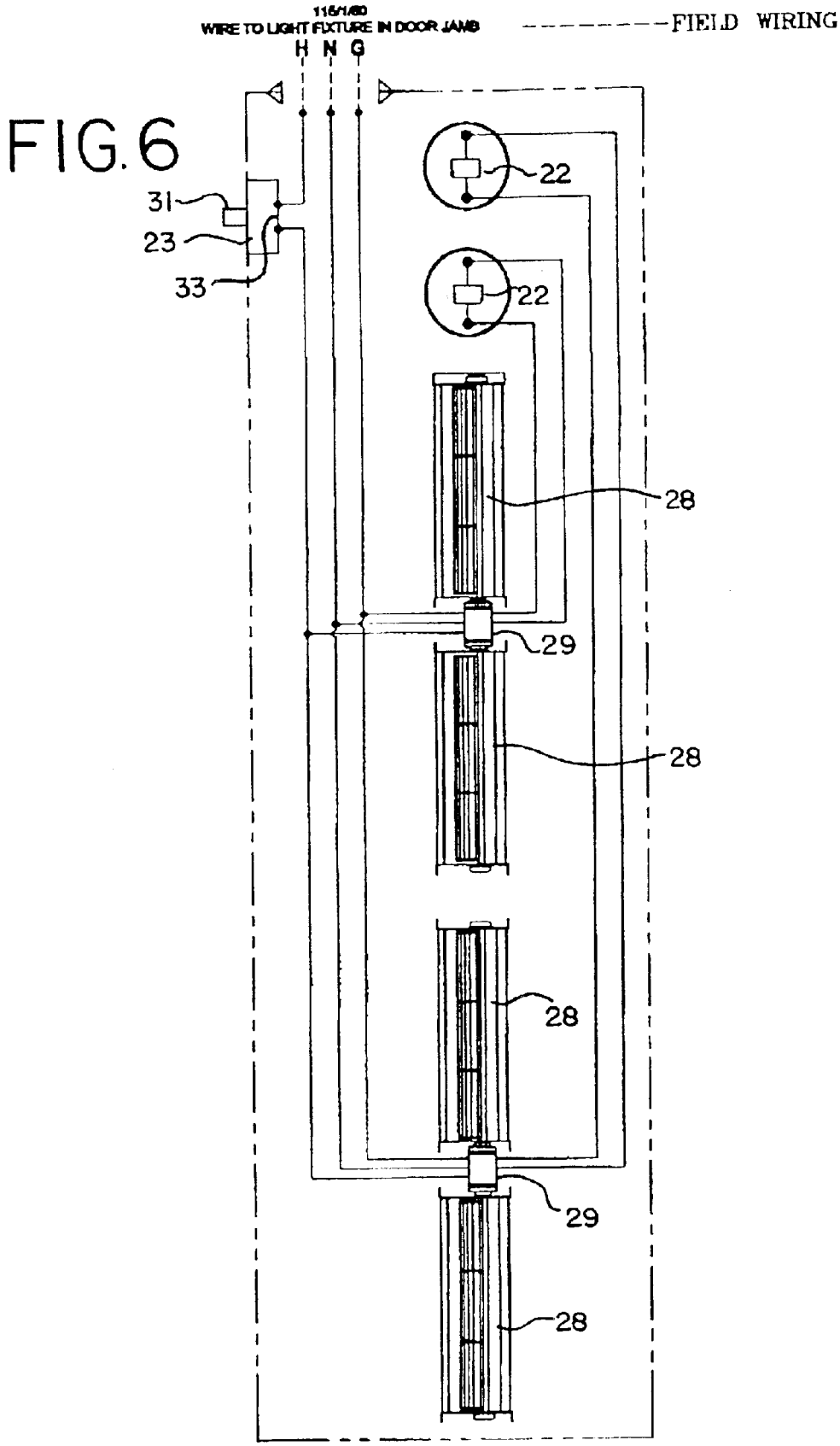
FIG. 6 is a schematic wiring diagram of the electrical circuit for the air curtain device of FIG. 1.

The air curtain device 20, best seen in FIG. 4, includes an air moving device drawing air in from the refrigerated compartment and emitting that air, such as one or more blowers 28, powered by one or more motors 29. In the preferred embodiment, there are four blowers 28, and two motors 29. The air curtain device 20 also includes one or more nozzles 35 best seen in FIG. 5 for discharging the air, a guard 24 covering the blower 28, nozzle 35 and the motor 29, and a control system. The control system of the preferred embodiment includes a sensor detecting whether the door is open. A preferred sensor is an electro-mechanical switch 23 that includes an actuator 31 and electrical contacts 33 as seen in FIG. 6. The actuator 31 is normally in contact with and depressed by the bracket 25 mounted on door 30; causing the contacts 33 to be open. When the door 30 is opened, the bracket 25 releases the actuator 31 and the contacts 33 close, providing power to the motors 29 (FIG. 6). This activates the motors 29 of the air curtain device 20. In some other embodiments, a sensor such as an electrical toggle switch or electronic sensor may be used to detect the door-opening.

The following sequence of events occurs when the door 30 of the cooler 10 is opened. The cooling unit 70 of the cooler 10 itself may or may not be operating. When the door 30 is opened, the switch 23, which is normally in a closed position, opens as well. When the switch 23 opens, the motors 29 are energized the wheels of the blowers 28 immediately start to turn, which creates airflow across the doorway 90. In the preferred embodiment the motors 29 ramp up to speed very quickly. As a result, the air curtain operates at full speed almost immediately when the door 30 is opened. The air emitted by the blowers 28 forms a horizontal curtain of air, going from the inside of the door across the doorway 90 at the direction represented by the arrows 60.

It has been found that the air curtain does not need to cover the entire opening of the doorway. Upon opening of the door 30, the cold air inside the cooler 10 attempts to rush out in the lower quarter portion of the doorway 90. When that occurs, warm air from the ambient outside attempts to rush in the upper quarter portion of the doorway 30. Thus, if the air curtain can inhibit the flux of cold air from passing out the bottom of the doorway, there is no missing air that can be replaced with warm air from the outside ambient. The present inventors have found that if the air curtain inhibits the cool air from passing out the lower ⅔ to ¾ of the doorway 90, the warm air is naturally inhibited from entering the upper portion of the doorway 90. Thus, in preferred embodiments of the invention, energy is saved by creating an air curtain covering only the lower ⅔ to ¾ portion of the doorway 90.

The angle that the air is discharged from nozzles 35 compared to the plane of the doorway 90 is an important factor that allows the air curtain to inhibit the flow of cold air out of the cooler 10. In the cooler according to the preferred embodiment, the air curtain is angled back at an angle inside the door 30 as shown in FIG. 5. Line 62 represents a plane parallel to the plane of the doorway 90. Arrow 63 represents the center of the flow patter or air discharged from nozzle 35. Angle 64 is thus the angle that the air is discharged compared to the plane of the doorway. Having the air discharged at this angle helps the air curtain resist the outflow of cold air via doorway 90. The flow of the air in the air curtain at an angle creates a force that basically negates the force caused by higher pressure of the denser, colder air inside the cooler.

To create the angled air curtain, the blowers 28 blow the air via angled nozzle 35 best shown in FIG. 5. In the preferred embodiment, the angle of the air discharge nozzle 35 is pre-configured and constant. Of course, the angle 64 may be different for different installations, but once the cooler is installed it is best to have the angle non-adjustable, that way an untrained user will not inadvertently change the angle of the air discharge nozzle 35 to one that is less effective. In addition, it is preferred that the angle at which the air is discharged is generally uniform over the height of the air curtain. For a 34" wide door, and one air curtain device, a preferred angle 64 is about 30°. This angle is dependent on other factors as discussed below. As a result, the angle 64 may range between 5° and 45°. Typically, the angle 64 will be between 5° and 40°, preferably between 10° and 38°. More typically the angle will be between 15° and 36.5°. Most preferably the angle will be between 20° and 35° compared to the plane of the doorway. This angle at which the nozzle 35 is oriented with respect to the wall 50 (and hence doorway) of the cooler determines the angle of the air curtain as denoted by arrows 60 in FIG. 1. The angle of the air discharge nozzle 35 is specified to ensure that air leaving the nozzle counters the air attempting to leave the cooler 10.

A second factor defining the characteristics of the air curtain is the width of an air discharge nozzle 35. The width of the air discharge nozzle 35 has an effect on the amount of air that the blowers 29 are able to emit. Typically the nozzle 35 will have a rectangular configuration with a width of between ½ and 5 inches. The height of the air discharge nozzles will depend on the number of nozzles. When four nozzles are used, covering the lower ⅔ of a standard doorway, each nozzle will have a height of between about 10 and about 14 inches. The air discharge nozzle 35 according to the preferred embodiment has a rectangular configuration with the width between ¾ and 2 inches. Some blowers may have a tighter nozzle, which may reduce the amount of the volume of air emitted by the blowers. In the preferred embodiment the width of the nozzle 35 is 1⅛ inch.

A third factor defining the characteristics of the air curtain is the angle at which the air spreads as it is discharged. In FIG. 5, arrows 65 and 66 represent the outer boundary of the air discharge. The angle 68 between those arrows is thus the spread angle of the discharge nozzle 35. For wider doorways, the spread angle needs to be narrower to maintain air speed. In a doorway about 34 inches wide it is preferred that the spread angle 68 is between about 2° and about 15°, more preferably between about 2° and about 10°.

A fourth factor defining the characteristics of the air curtain is the velocity at which the blowers emit the air stream while creating the air curtain. The velocity of the air stream emitted by the blower is dependent on the motor speed. The velocity of air emission needs to be sufficient to ensure that air leaving the nozzle counters the air attempting to leave the cooler across the entire width of the doorway 90.

The velocity of the air changes as the air stream leaves the nozzle and reaches the other side of the doorway 90. The velocity of the air stream at the nozzle outlet is very important. Therefore, the velocity of the air stream emitted by the blowers 28 must be sufficient, and matched to the size of the cooler 10 and the size of the door 30, so that the air curtain can still inhibit the escape of the cold air on the far side of the doorway 90. The air curtain for larger doors may therefore need an air stream with a higher velocity. In the preferred embodiment, the air discharge nozzle 35 discharges air at a velocity which is substantially the same over the entire height of the air curtain and which is preferably at a velocity of at least 200 feet/min. More preferably, the discharge speed is higher so that the air is still moving at 250 feet/min at the far side of the doorway 90. (The far side of the doorway is defined as a line resulting from an intersection of the plane containing the center line 63 of the air flow and a plane containing the face of the door casing opposite the side of the doorway where the air curtain device is mounted, which is usually the hinge side.) Thus the air speed at the nozzle discharge is preferably between 500 and 2000 feet/min.

As noted above, the blower speed, and hence the air discharge velocity, is a function of the motor speed. The motor speed should be selected according to the diameter of the blower 28. It is preferable to use smaller diameter blowers to reduce the amount of space that the air curtain device 20 occupies inside the cooler. Because the blower size is small, a higher speed motor, preferably one that can reach a speed of at least 1000 RPM, is needed. More preferably the motor can reach a speed of 1500 RPM. The preferred embodiment uses a blower with a rotation speed of about 1650 RPM and the diameter of the blower wheel is 65 mm. The preferred embodiment has four 12" long tangential blowers, powered by two 1/25 horsepower PSC dual-action fan motors. The preferred embodiment also has the blowers and the motors vertically mounted together in a stacked manner as shown in FIG. 4.

The volume of air stream emitted by the air discharge nozzle while creating the air curtain is in part a function of the blower speed and in part a function of the width of the discharge nozzle. Large volumes of air can be emitted to create an air curtain for a larger cooler. Conversely, a lesser volume of air is emitted for creating an air curtain of a smaller cooler. In the preferred embodiment the speed of the blower cannot be changed, and the blowers have only one speed.

As shown in FIG. 5, the cross section of the guard 24 of the air curtain device 20 has the shape of a rectangle with a beveled corner. The triangular area 27 between the blower 28 and the backing plate 57 holds the wiring in such a way that the wiring is hidden in a raceway.

Generally the size of the cooler door determines the attributes needed in the air curtain device. More powerful motors and perhaps larger blowers can be used for a larger size doorway. In the preferred embodiment, as shown in FIG. 1, the door is about 34" wide and about 78" tall. Hence the air stream velocity, air stream volume and nozzle angle are chosen to create the air curtain for the door sized 34" by 78". In the preferred embodiment the air curtain reduces the rise in the cooler's average temperature when the door is left open for 15 minutes by at least 2.5°, when measured in an empty cooler.

In a typical walk-in cooler, a light is mounted on the door jamb itself on the inside of the walk-in. This light may be an incandescent or fluorescent light. The light inside the compartment is not in the center of the compartment, but on one side of the doorjamb. The wall panel and the door have a built-in conduit and junction box. Additionally, the cooler may have a switch on the wall that may be flipped on by someone walking into the cooler. The air curtain device may be tied into the electrical system of the cooler at the junction box.

While installing the cooler 10, caution must be taken to place the bracket 25 on the door 30 at the exact location to ensure that the bracket will activate the switch 23 when the door 30 is opened.

In the preferred embodiment the air curtain device 20 uses PSC motors, which need a capacitor. The capacitors are generally mounted on the PSC motor itself, but in the preferred embodiment, as shown in FIGS. 4 and 6, the capacitors 22 are relocated in the wiring storage area 26 located under the top portion of the guard 24, as shown in FIG. 1. Other energy efficient motors may be used which may not need a capacitor, such as solid state commutated motors, C-frame motors, or shaded pole motors. Alternatively, the air curtain device 20 may employ a DC motor or a split phase motor. The wiring for the air curtain device 20 is hidden in the wiring storage area 26, also shown in FIG. 4. The reason for selecting this location for the wiring is to provide a user with easy access to the electrical components of the air curtain device.

Even though a tangential wheel blower is widely used for many purposes, the preferred embodiment's use of the blower mounted with a vertical axis of rotation and emitting air through the angled nozzle 35 is unique. The blower could be one that is manufactured by Eucania. A preferred blower is Eucania tangential blower model TGH65. The blower wheel, the scroll element, and the baffle are the elements that actually align in the air curtain device, and are pre-assembled by the blower manufacturer. As shown in FIG. 4, the motors 29 and blowers 28 are mounted on the backing plate 57 in a manner to ensure that when the air curtain device 20 is mounted to the front wall 55 of the cooler, the blowers will emit the air stream at an angle compared to the backing plate 57 and hence to the front cooler wall 55, which ultimately results in causing the angled air curtain.

In the preferred embodiment, the air curtain device is made from stainless steel and the air curtain device guards are made of an epoxy-coated wire material. The guards 24 could also be chrome-plated. Alternatively, the guards could be made from galvanized steel or aluminum, or most any other metal. The wire guards could be plated with a coating other than the epoxy coating. The preferred embodiment uses the epoxy coating for sanitation reason and because it is approved by NSF for use inside of a walk-in cooler compartment. As shown in FIG. 4, the wire guard spacing preferably meets the UL safety standard that prevents the user from inadvertently sticking his fingers into the fan blade. The cooler 10 of the preferred embodiment is preferably pre-wired with 115 volt power. The preferred cooler 10 provides an electrical stub so that the air curtain device may be hard wired.

The air curtain device 20 may be installed as the cooler 10 is built, or it may be sold as a standalone device that can be installed in an existing cooler. Approximately the top 1/5 portion of the air curtain device constitutes the wiring storage space 26. All of the electrical access for the air curtain device is located in the wiring storage space 26. The top of the guard 24 has a flexible circular opening 21 by which external wiring, such as conduit, may be attached to the top of the cover and supply power to the air curtain devices 20. This hole can be formed as a knock-out common in electrical wiring so that it can remain closed when the device 20 is hard wired in, but be opened when the device 20 is molded as a retrofit to an existing cooler 10. The guard 24 is attached to the air curtain device backing plate 57 with screws. However, the guard could also snap onto the backing plate 57 or friction fit with the backing plate 57.

The walls 50 and the ceiling 80 of the cooler of the preferred embodiment as shown in FIGS. 2, 3 are insulated by a polyurethane insulation. The floor 40 may or may not be insulated. The walls and the ceiling of the cooler according to the preferred embodiment could also be insulated with fiberglass, open or closed cell foam, polystyrene, wood chips etc. The wall and the ceiling insulations are not visible to the user.

Figure 7:
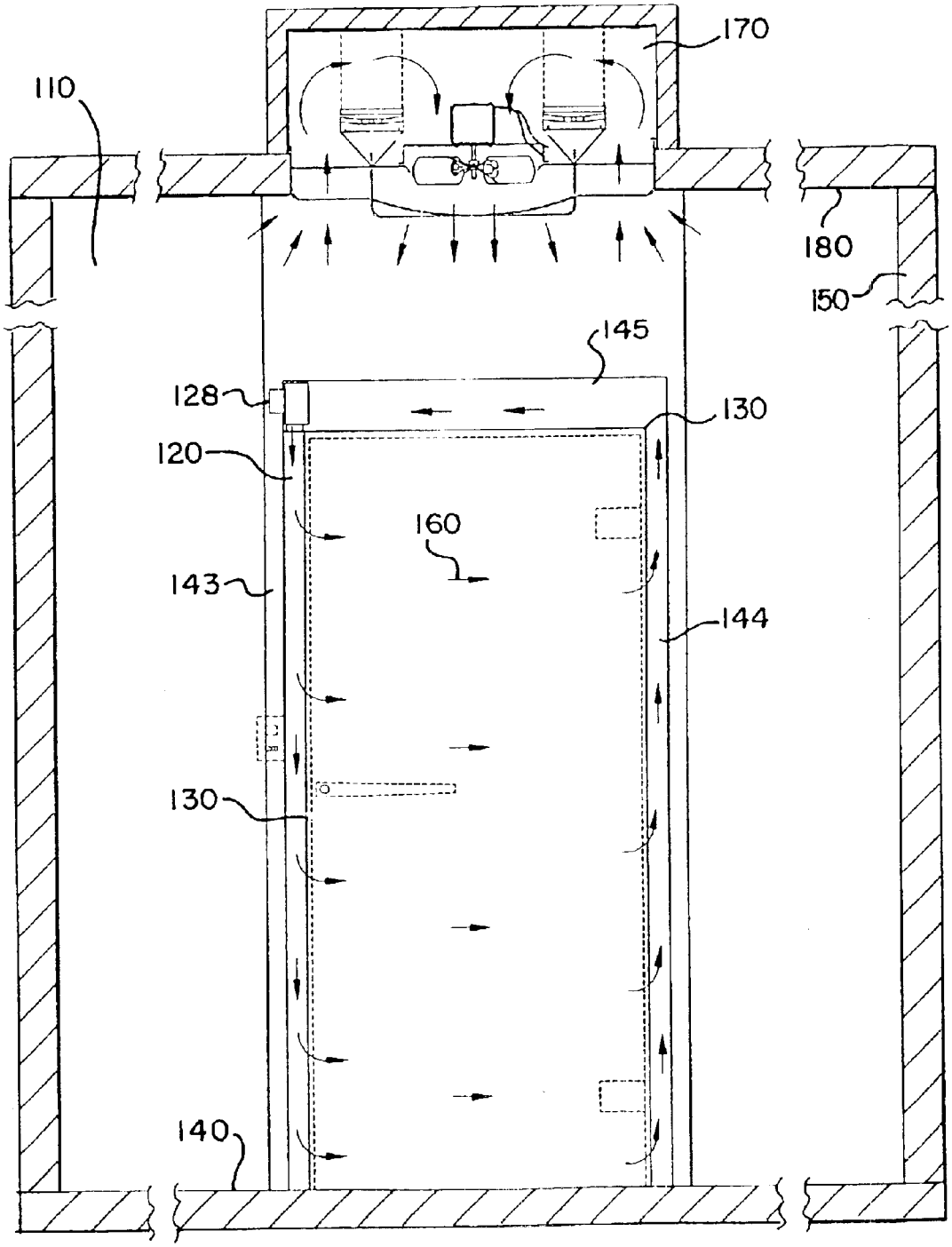
FIG. 7 is a cross-sectional view of a cooler as in FIG. 3 but of a second embodiment of the invention.

A second embodiment of the invention is shown in FIG. 7. The cooler 110 uses a different air curtain device 120 using a single air moving device 128 and a different nozzle arrangement, but again creates a horizontal air curtain. Ducts 143 and 144 are positioned along both of the lengthwise sides of the door 130. A feed duct 145 is located above the top of the door 130. The temperature of the air curtain is constant over the height of the air curtain and is the same as the temperature of the cooler because the air for the air curtain is drawn into the duct 144 from the refrigerated compartment, and partly from recirculating air in the air curtain. The arrows 160 denote the direction of the airflow in the cooler 110. A blower 128 is positioned on the wall above the left top corner of the door 130. The blower 128 circulates the airflow through the ducts 143, 144 and 145. As with the cooler 10 of FIG. 1, the cooler 110 has an insulated floor 140 and insulated walls 150. The cooling unit 170 may be positioned on the roof 180 of the cooler 110 in its conventional location, or it may be placed in the roof so as to be centered with respect to the doorway as shown in FIG. 7.

Figure 8:
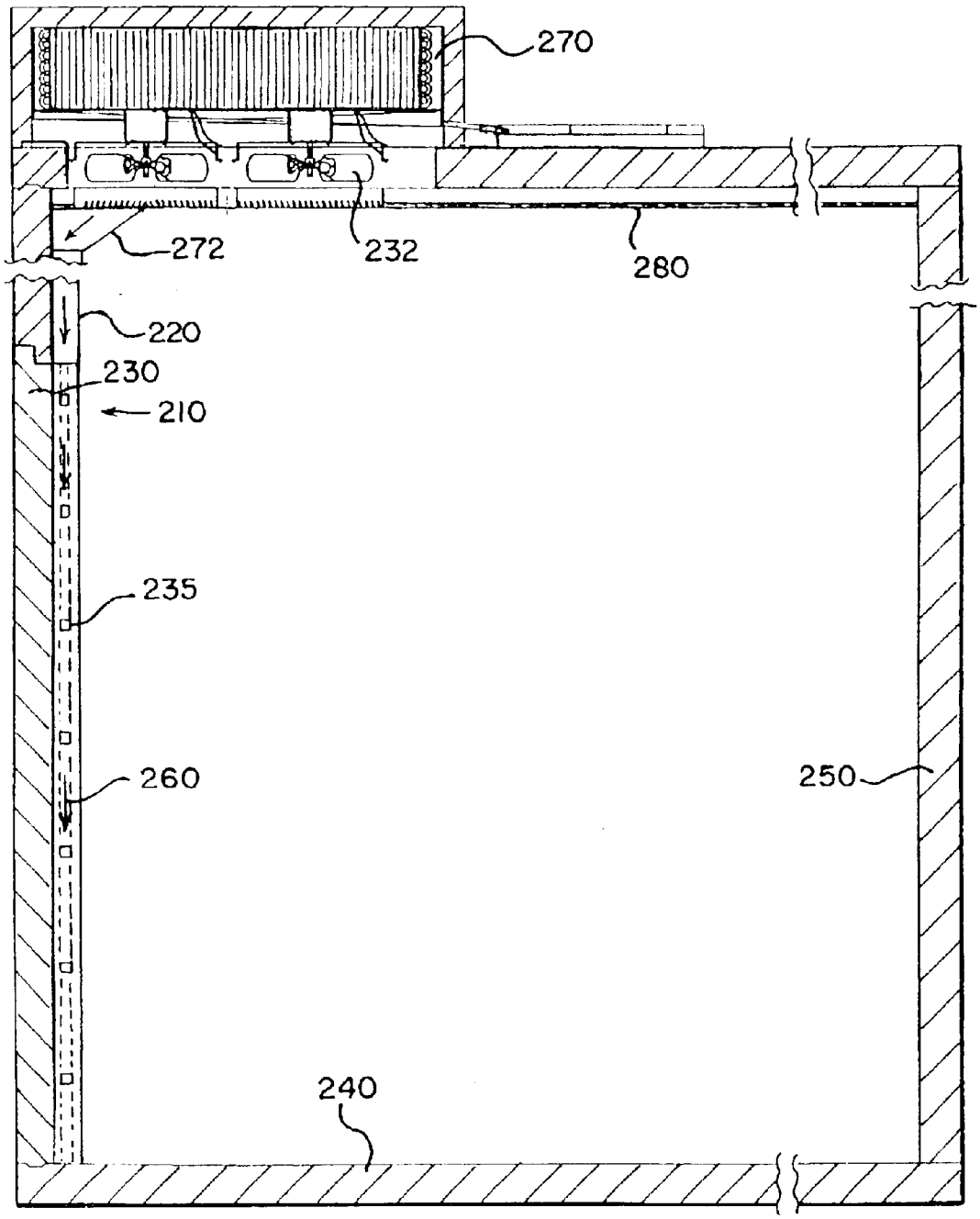
FIG. 8 is a cross-sectional view of a cooler as in FIG. 2 but of a third embodiment of the invention.

FIG. 8 shows a third embodiment of the present invention. In this embodiment, the cooling unit 270 is located at the front of the cooler 210 in the area over the door 230. No additional air moving device is used. Instead, the fan 232 that blows air past the evaporator coils provides the air used in the air curtain. Just below the cooling unit 270 an air duct 272 is located through which the cool air from the cooling unit 270 is circulated down in the cooler in the direction represented by arrow 260. The door open detection switch is not shown. The door 230 and walls 250 and ceiling 280 are same as described in the first embodiment shown in FIG. 1.

Figure 9:
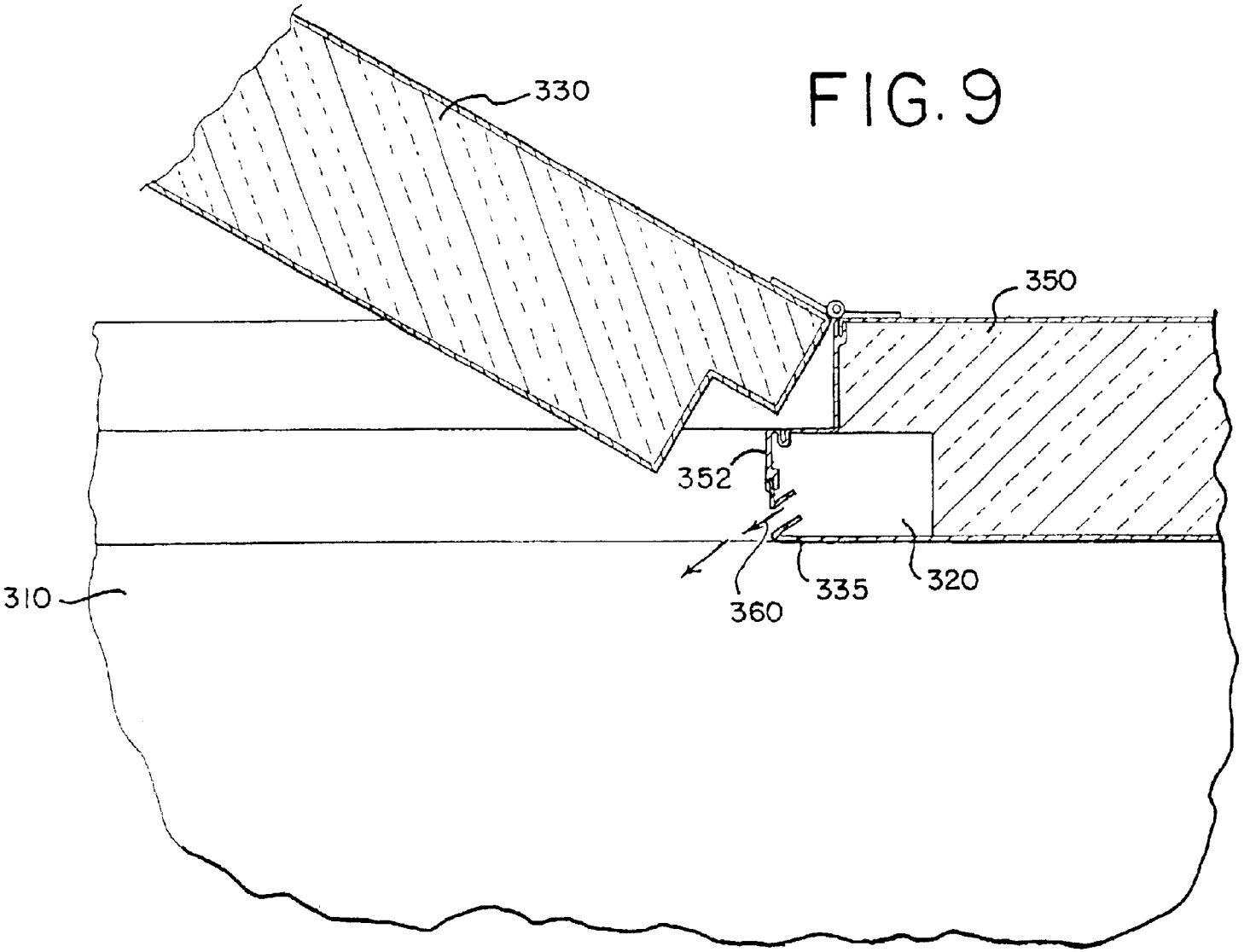
FIG. 9 is a cross-sectional view similar to FIG. 5 but of a fourth embodiment of the invention.

In the fourth embodiment of the invention shown in FIG. 9, the air curtain is produced by air nozzles built into the doorjamb 352. A duct is formed as an area 320 formed in the insulation within the walls 350 right behind the doorjamb 352. Air may be supplied to this duct by a separate air moving device (not shown) like the blower 128 of FIG. 7, or air may be directed into the duct from the fan used to blow air past the evaporator coils, as shown in FIG. 8. The nozzles 335 are angled and positioned to create an angled air curtain over the lower portion of the doorway closed by door 330, in the direction of arrow 360, as with the first embodiment of the invention shown in FIG. 1.

Figure 10:
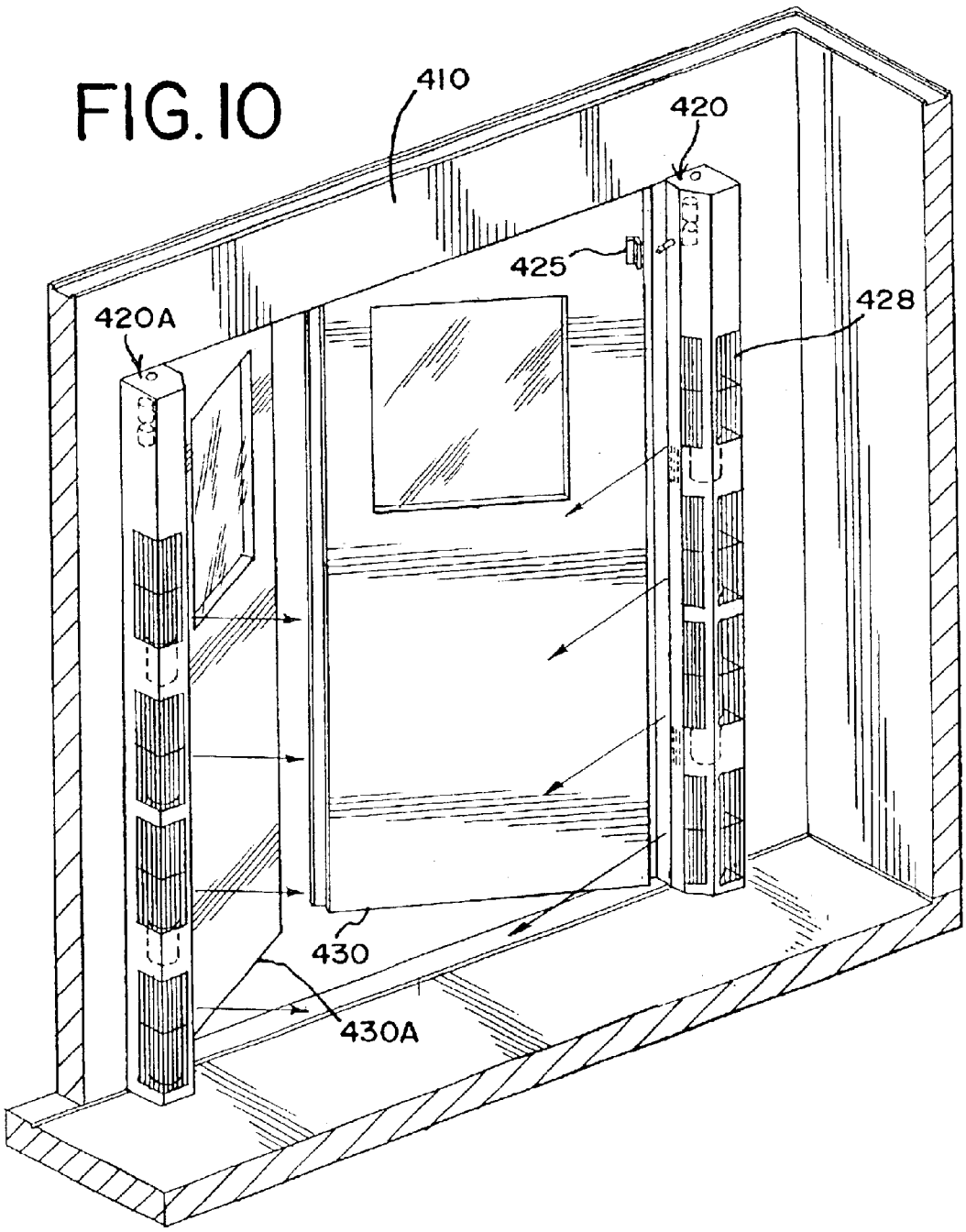
FIG. 10 is a partial sectional and perspective view like FIG. 1 but of a fifth embodiment of the invention.

In yet another embodiment, a two-door cooler 410 may have one air curtain device mounted at the hinge side of each door as shown in FIG. 10. A bracket 425 is attached to each of doors 430 and 430A, as shown in FIG. 1. Each of the air curtain devices 420 and 420A are just like air curtain device 20 of the first embodiment of FIGS. 1–5. However, the number of the motors and the size of the blower wheels and capacity of motors can be changed according to the size of the cooler. It is also possible to use four motors each powering a single blower. The blowers 428 and 428A of the present embodiment may also be centrifugal blowers. The switch contacting the bracket 425 of each door would separately start the motor for the air curtain device for that door. The power to the motor may be turned on instantaneously when the detector senses that door is opened, or in some other fashion still in conjunction with the opening of the door. Similarly the power to the motor may be turned off instantaneously when the detector senses that door is closed, or in some other fashion still in conjunction with the closing of the door.

Figure 11:
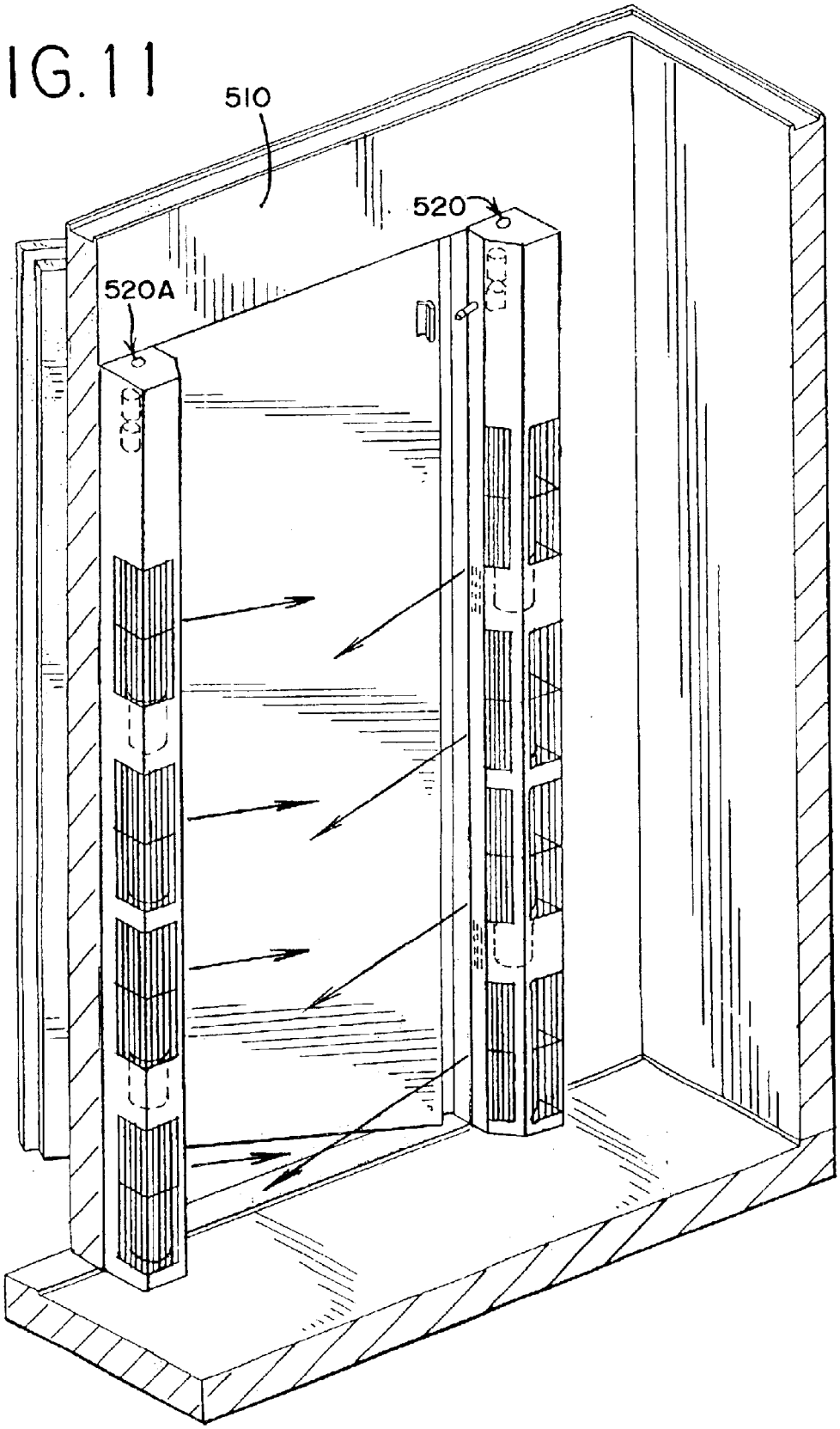
FIG. 11 is a partial cross-sectional view like FIG. 1 but of a sixth embodiment of the invention.

FIG. 11 depicts an embodiment where the cooler 510 has two air curtain devices 520 and 520A installed on each side of a doorway that is closed by only one door. In this case, both devices are wired to be activated by a single switch detecting when the door is open.

Even though the air curtain of the preferred embodiment covers across ¾ of the door opening, in another embodiment the air curtain may cover the lower ⅔ of the door opening and reduce the amount of cool air escaping from the lower ⅔ of the area of the doorway and the amount of warm air entering through the upper ⅓ portion of the doorway.

As will be readily understood, the cooler size may be a varied from that shown. The cooler size will have a bearing on the parameters of the preferred air curtain device, such as the velocity and volume of air, and the angle and width of the air discharge nozzle. The air discharge nozzle for a smaller size door may only need to discharge air at a velocity of 500 feet/min., and that for a larger door size may need to discharge air at a velocity of 2000 feet/min.

Additionally, although the air discharge nozzle according to the preferred embodiment discharges an air stream at an angle of about 30° from the plane of the doorway, and has a rectangular configuration with a width between ½ and 5 inches, in another embodiment the angle of an air discharge nozzle may be different to maximize the efficiency of the air curtain for a given size of cooler.

The preferred embodiment of the invention provides a compact air curtain device which requires less space. More specifically, the device with four blowers and two permanent split capacitance (PSC) motors fit snuggly in the device assembly having dimensions of about 5 inches by 5 inches by 80 inches. However, because one side is beveled, the preferred device takes up a volume of in less than 1 cubic foot. The compactness of the air curtain device promotes optimal use of the valued interior cooler space. The simple design of the air curtain of the preferred invention makes the device easier to use and less costly to manufacturing than prior art devices. Also, due to the compactness and self-contained nature of the preferred air curtain device, it can be installed as a retrofit in exiting coolers.

A test was conducted in which temperatures were measured at several places within a walk-in cooler having an internal dimension of 10 feet wide by 11 feet deep by 8½ feet tall, providing a refrigerated compartment of about 935 cubic feet. The door was 34 inches wide by 78 inches tall. The cooler was empty for some of the tests. Fifteen thermometers (numbered 1–7, 9, 11–16 and 18) were placed at various locations within the refrigerated compartment, as outlined in Table 1.

TABLE 1

| Thermometer No. | Lateral Location | Height |
|---|---|---|
| 1 | 12 in. out from each wall of back left corner | 12 in. down from ceiling |
| 2 | 12 in. out from each wall of back left corner | Center |
| 3 | 12 in. out from each wall of back left corner | 12 in. up from floor |
| 4 | 12 in. out from each wall of front left corner | 2 in. down from ceiling |
| 5 | 12 in. out from each wall of front left corner | Center |
| 6 | 12 in. out from each wall of front left corner | 12 in. up from floor |
| 7 | 12 in. out from each wall of back right corner | 12 in. down from ceiling |
| 9 | 12 in. out from each wall of back right corner | 12 in. up from floor |
| 11 | 12 in. out from each wall of front right corner | 12 in. down from ceiling |
| 12 | 12 in. out from each wall of front right corner | 12 in. center |
| 13 | 12 in. out from each wall of front right corner | 12 in. up from floor |
| 14 | Center of room | 12 in. down from ceiling |
| 15 | Center of room | Center |
| 16 | Center of room | 12 in. up from floor |
| 18 | 12 in. out from each wall of back right corner | Center |

The test was run with the air curtain device 10 running. A control test in which the air curtain device was not running was also conducted. The measured temperatures are shown in Tables 2 and 3.

TABLE 2

(Control - no air curtain)

| TIME | TEMPERATURE (° F.) 0 min. | 5 min. | 10 min. | 15 min. |
|---|---|---|---|---|
| Thermometer No. | | | | |
| 1 | 35.3 | 51.3 | 51.2 | 50.7 |
| 2 | 35.2 | 48.1 | 49.8 | 50.6 |
| 3 | 35 | 45.7 | 48.3 | 49.8 |
| 4 | 35 | 50.6 | 50.7 | 51 |
| 5 | 35.1 | 52.4 | 52.8 | 53.5 |
| 6 | 35 | 50.6 | 51.3 | 51.7 |
| 7 | 35.7 | 51.3 | 52.4 | 51.3 |
| 9 | 36.1 | 46.9 | 48.8 | 50.1 |
| 11 | 35 | 49.9 | 49.7 | 49.5 |
| 12 | 35.2 | 51.8 | 52.3 | 52.5 |
| 13 | 35.1 | 49.7 | 50.6 | 51 |
| 14 | 35 | 53.5 | 53 | 53.3 |
| 15 | 35 | 50.6 | 52.6 | 52.9 |
| 16 | 35 | 48.6 | 50.4 | 51.2 |
| 18 | 35.5 | 48.7 | 50.3 | 50.4 |
| Average | 35.2 | 50.0 | 50.9 | 51.3 |

TABLE 3

(with air curtain)

| TIME | TEMPERATURE (° F.) 0 min. | 5 min. | 10 min. | 15 min. |
|---|---|---|---|---|
| Temperature No. | | | | |
| 1 | 35.6 | 44.9 | 47.5 | 49.2 |
| 2 | 35.5 | 44.8 | 47.6 | 49.2 |
| 3 | 35.6 | 44.6 | 47.3 | 48.8 |
| 4 | 35.2 | 44.3 | 47.2 | 48.7 |
| 5 | 35.2 | 44.7 | 47.3 | 49 |
| 6 | 35.4 | 44.4 | 47.1 | 48.8 |
| 7 | 36 | 44.9 | 47.3 | 48.9 |
| 9 | 36.4 | 46.3 | 48.8 | 50.5 |
| 11 | 35 | 43.8 | 46 | 46.8 |
| 12 | 35.3 | 44.9 | 47.4 | 48.3 |
| 13 | 35.1 | 45.6 | 48.2 | 49 |
| 14 | 35.2 | 43.2 | 45.4 | 47.1 |
| 15 | 35.1 | 43.5 | 46 | 47.5 |
| 16 | 35.2 | 43.4 | 46.2 | 48 |
| 18 | 35.8 | 45.4 | 47.7 | 49.3 |
| Average | 35.4 | 44.6 | 47.1 | 48.6 |

Figure 12:
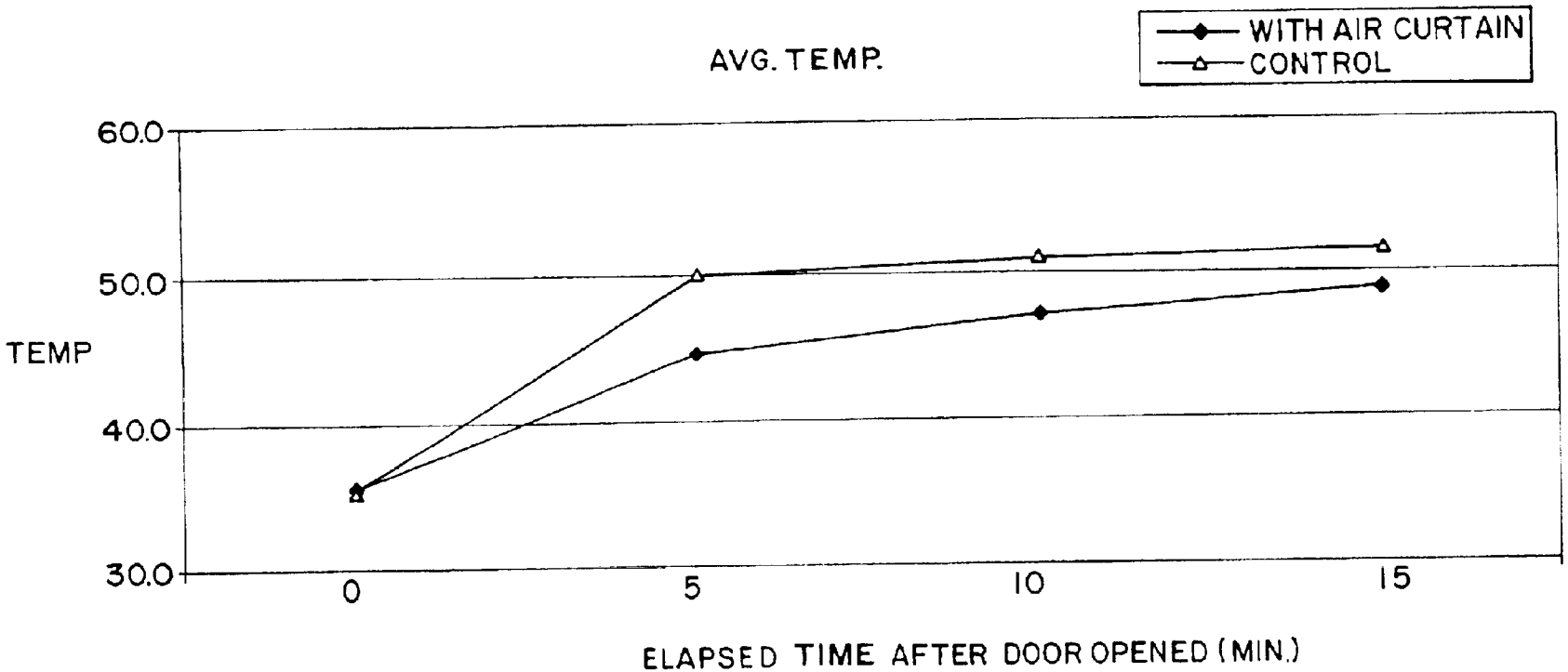
FIGS. 12–16 are graphs showing results of tests of the embodiment of the invention shown in FIG. 1–6.
Figure 13:
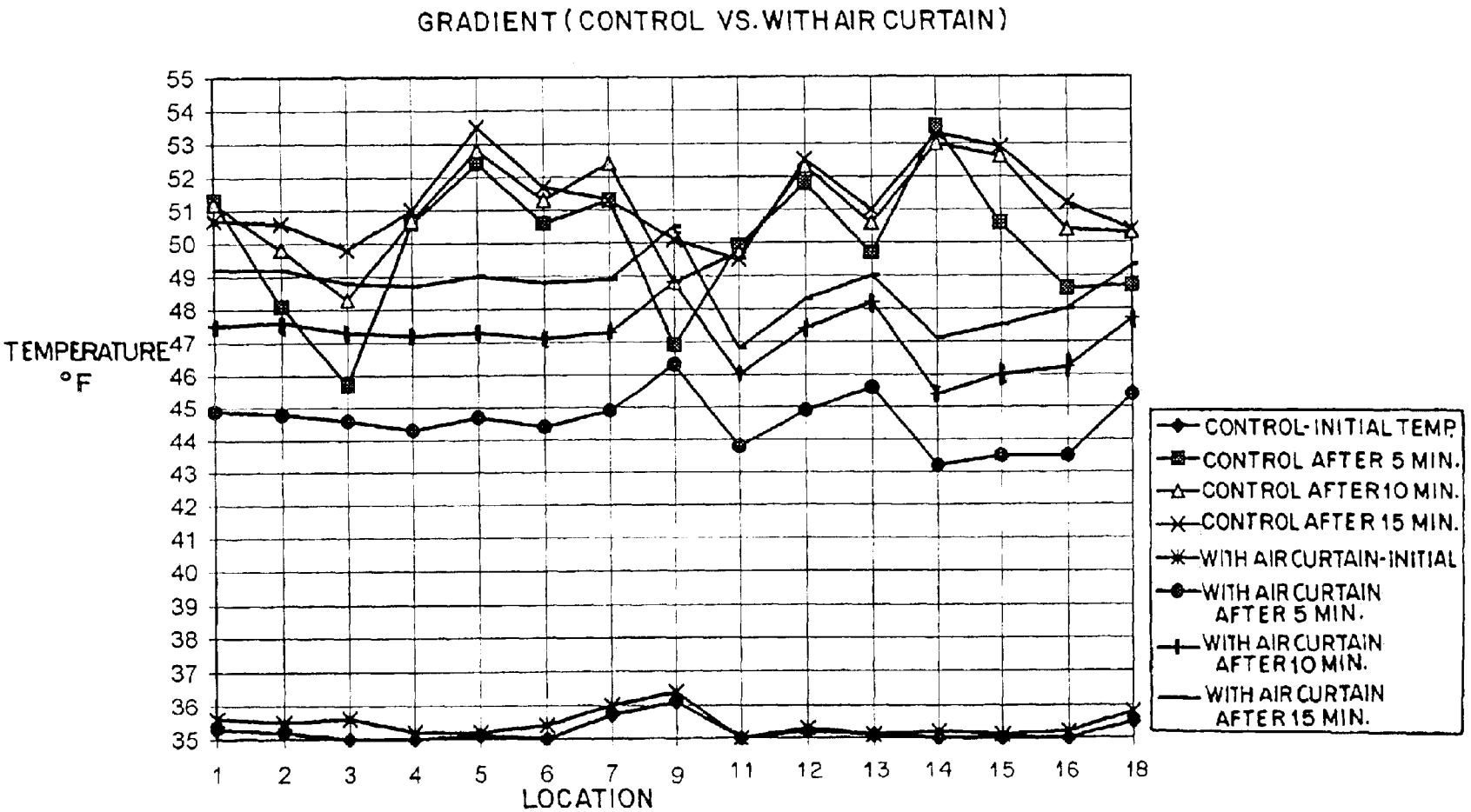

The average temperatures were plotted over time once the door was opened. The results are shown in FIG. 12. The starting average temperature of the cooler with the air curtain operational was 35.4° F., and the temperature of the cooler without an operating air curtain was 35.2° F. After 15 minutes, the temperature of the cooler with the air curtain operating was 48.6° F., and the temperature of the cooler without the air curtain operating was 51.3° F. This test showed tat after 15 minutes, the cooler using the air curtain had an average 13.2° F. temperature rise and the cooler that did not employ the air curtain device had an average temperature rise of 16.1° F.

Several additional tests were conducted to measure power consumption. First, a test was run with no air curtain (Test #480) and with the air curtain device of FIGS. 1–5 (Test #481). The cooler was equipped with a standard evaporator unit, which is depicted in FIG. 7. The test was run for 8 hours. The power consumption (in KWH) of the compressor/condenser unit, evaporator unit and air curtain unit (when used) is shown in Table 4. The air curtain, even though it used power to operate, resulted in a net savings of 8% for the total power consumption.

TABLE 4

Power consumption in 8 hours

| | | KWH |
|---|---|---|
| Test #481 no air curtain | Compressor/Condenser Unit | 6.302 |
| | Evaporator Unit | 1.858 |
| | Air Curtain | 0 |
| | Total | 8.16 |
| Test #480 with air curtain | Compressor/Condenser Unit | 5.64 |
| | Evaporator Unit | 1.839 |
| | Air Curtain | 0.021 |
| | Total | 7.5 |
| | Difference | 0.66 |
| | % difference | 8% |

Second, a similar test was run for a 24 hour period, except that a modular evaporator, as shown in FIG. 2, was used. Data from Test #486, with no air curtain, and Test #487, with an air curtain, is shown in Table 5. During the third 8 hour period the door was not opened, and thus there was no air curtain power consumption. The air curtain resulted in a 9% energy savings for the 24 hour period.

TABLE 5

Power consumption in 24 hours

| | | KWH 1st 8 hrs | KWH 2nd 8 hrs | KWH 3rd 8 hrs | KWH 24 hrs |
|---|---|---|---|---|---|
| Test #486 - no air curtain | Compressor/ Condenser Unit | 7.793 | 9.032 | 7.789 | 24.614 |
| | Evaporator Unit | 2.253 | 2.351 | 2.41 | 7.014 |
| | Air Curtain | 0 | 0 | 0 | 0 |
| | Total | 10.046 | 11.383 | 10.199 | 31.628 |
| Test #487 - with air curtain | Compressor/ Condenser Unit | 6.887 | 7.873 | 7.13 | 21.89 |
| | Evaporator Unit | 2.251 | 2.294 | 2.373 | 6.918 |
| | Air Curtain | 0.024 | 0.023 | 0 | 0.047 |
| | Total | 9.162 | 10.19 | 9.503 | 28.855 |
| | Difference | 0.884 | 1.193 | 0.696 | 2.773 |
| | Energy % Savings | 9% | 10% | 7% | 9% |

Third, another series of tests were run in which an empty cooler was equipped with the inventive air curtain of FIGS. 1–5 (Test #490), and with a prior art vertical overhead air curtain by Mars, Inc. (Test #492). A control test was also run with no air curtain (Test #489). The power consumption and run time of the refrigeration system and the air curtain device were recorded and cumulated over an 8 hour test period, and the results are shown in Tables 6, 7 and 8.

TABLE 6

| | | Inventive air curtain power consumption (KWH) | | | | |
|---|---|---|---|---|---|---|
| | | Test #490 With inventive air curtain | | | | |
| Hours | Time | Compressor/ condenser unit (cumulative) | Compressor/ condenser unit (hourly) | Evaporator unit (cumulative) | Air curtain (cumulative) | Total (cumulative) |
| 0 | 6:30 | 0 | 0 | 0 | 0 | 0 |
| 1 | 7:30 | 0.6577 | 0.6577 | 0.225 | 0.003 | 0.8857 |
| 2 | 8:30 | 1.3253 | 0.6676 | 0.454 | 0.006 | 1.7853 |
| 3 | 9:30 | 1.968 | 0.6427 | 0.682 | 0.009 | 2.659 |
| 4 | 10:30 | 2.598 | 0.63 | 0.911 | 0.011 | 3.52 |
| 5 | 11:30 | 3.236 | 0.638 | 1.139 | 0.014 | 4.389 |
| 6 | 12:30 | 3.863 | 0.627 | 1.367 | 0.016 | 5.246 |
| 7 | 1:30 | 4.506 | 0.643 | 1.592 | 0.019 | 6.117 |
| 8 | 2:30 | 5.143 | 0.637 | 1.825 | 0.022 | 6.99 |

Total compressor/condenser unit run time: 250.6 min.

TABLE 7

| | | Prior art air curtain power consumption (KWH) | | | | |
|---|---|---|---|---|---|---|
| | | Test #492 With Mars overhead air curtain | | | | |
| Hours | Time | Compressor/ condenser unit (cumulative) | Compressor/ condenser unit (hourly) | Evaporator unit (cumulative) | Air curtain (cumulative) | Total (cumulative) |
| 0 | 6:30 | 0 | 0 | 0 | 0 | 0 |
| 1 | 7:30 | 0.7455 | 0.7455 | 0.22 | 0.003 | 0.9685 |
| 2 | 8:30 | 1.4652 | 0.7197 | 0.45 | 0.008 | 1.9232 |
| 3 | 9:30 | 2.201 | 0.7358 | 0.68 | 0.012 | 2.893 |
| 4 | 10:30 | 2.936 | 0.735 | 0.912 | 0.016 | 3.864 |
| 5 | 11:30 | 3.656 | 0.72 | 1.141 | 0.02 | 4.817 |
| 6 | 12:30 | 4.387 | 0.731 | 1.365 | 0.024 | 5.776 |
| 7 | 1:30 | 5.108 | 0.721 | 1.593 | 0.028 | 6.729 |
| 8 | 2:30 | 5.826 | 0.718 | 1.819 | 0.032 | 7.677 |

Total compressor/condenser unit run time: 283.72 min.

TABLE 8

| | | Control - no air curtain power consumption (KWH) | | | |
|---|---|---|---|---|---|
| | | Test #489 No Air Curtain | | | |
| Hours | Time | Compressor/ condenser unit (cumulative) | Compressor/ condenser unit (hourly) | Evaporator unit (cumulative) | Total (cumulative) |
| 0 | 6:30 | 0 | 0 | 0 | 0 |
| 1 | 7:30 | 0.8107 | 0.8107 | 0.231 | 1.0417 |
| 2 | 8:30 | 1.5363 | 0.7256 | 0.46 | 1.9963 |
| 3 | 9:30 | 2.248 | 0.7117 | 0.686 | 2.934 |
| 4 | 10:30 | 2.941 | 0.693 | 0.914 | 3.855 |
| 5 | 11:30 | 3.667 | 0.726 | 1.154 | 4.821 |
| 6 | 12:30 | 4.34 | 0.673 | 1.383 | 5.723 |
| 7 | 1:30 | 5.009 | 0.669 | 1.611 | 6.62 |
| 8 | 2:30 | 5.681 | 0.672 | 1.838 | 7.519 |

Total compressor/condenser unit run time: 275 min.

Table 9 gives a comparison of the hourly differences in energy usage for the compressor/condenser unit. Table 10 gives the percentage differences for the compressor/condenser unit, and Table 11 gives the percentage differences for the cumulative power usage for the total cooler.

TABLE 9

| | | Comparison of power consumption of compressor/condenser units | | |
|---|---|---|---|---|
| | | Hourly KWH Compressor/condenser Unit | | |
| Hours | Time | Test #'s 492–490 | Test #'s 492–489 | Test #'s 489–490 |
| 0 | 6:30 | Diff | Diff | Diff |
| 1 | 7:30 | 0.0878 | 0.0652 | 0.153 |
| 2 | 8:30 | 0.1399 | 0.0711 | 0.211 |
| 3 | 9:30 | 0.233 | 0.047 | 0.28 |
| 4 | 10:30 | 0.338 | 0.005 | 0.343 |
| 5 | 11:30 | 0.42 | 0.011 | 0.431 |
| 6 | 12:30 | 0.524 | −0.047 | 0.477 |
| 7 | 1:30 | 0.602 | −0.099 | 0.503 |
| 8 | 2:30 | 0.683 | −0.145 | 0.538 |
| | | Mars vs. inventive | Mars vs. Control | Control vs. Inventive |

TABLE 10

| | Percentage difference in power consumption for compressor/condenser unit | | | |
|---|---|---|---|---|
| | | Cumulative KWH Compressor/condenser unit | | |
| | Time | Test #'s 492–490 | Test #'s 492–489 | Test #'s 489–490 |
| Hours | | | | |
| 0 | 6:30 | % Diff | % Diff | % Diff |
| 1 | 7:30 | 13% | 8% | 23% |
| 2 | 8:30 | 11% | 5% | 16% |
| 3 | 9:30 | 12% | 2% | 14% |
| 4 | 10:30 | 13% | 0% | 13% |
| 5 | 11:30 | 13% | 0% | 13% |
| 6 | 12:30 | 14% | −1% | 12% |
| 7 | 1:30 | 13% | −2% | 11% |
| 8 | 2:30 | 13% | −3% | 10% |
| Average | | 13% | 1% | 14% |
| | | Mars vs. Inventive | Mars vs. Control | Control vs. Inventive |

TABLE 11

| | | Cumulative KWH Total Systems | | |
|---|---|---|---|---|
| | Time | Test #'s 492–490 | Test #'s 492–489 | Test #'s 489–490 |
| Hours | | | | |
| 0 | 6:30 | % Diff | % Diff | % Diff |
| 1 | 7:30 | 9% | 8% | 18% |
| 2 | 8:30 | 8% | 4% | 12% |
| 3 | 9:30 | 9% | 1% | 10% |
| 4 | 10:30 | 10% | 0% | 10% |
| 5 | 11:30 | 10% | 0% | 10% |
| 6 | 12:30 | 10% | −1% | 9% |
| 7 | 1:30 | 10% | −2% | 8% |
| 8 | 2:30 | 10% | −2% | 8% |
| Average | | 9% | 1% | 11% |
| | | Mars vs Inventive | Mars vs. Control | Control vs. Inventive |

Figure 14:
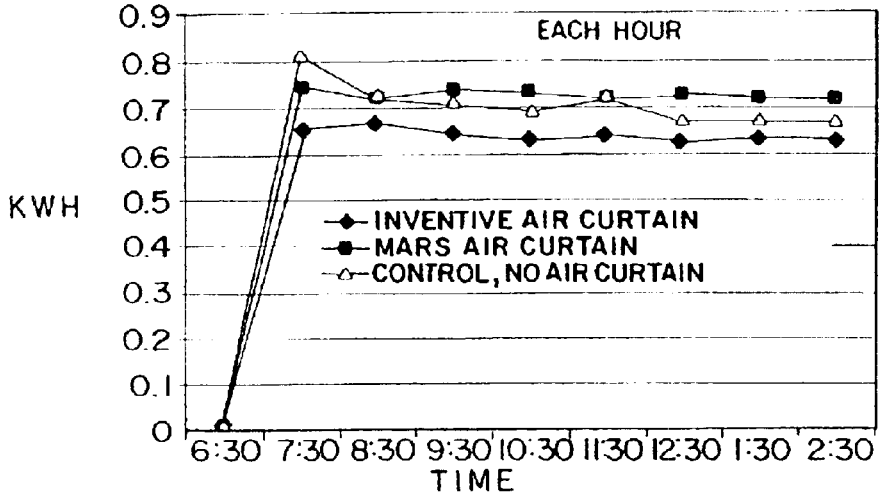
Figure 15:
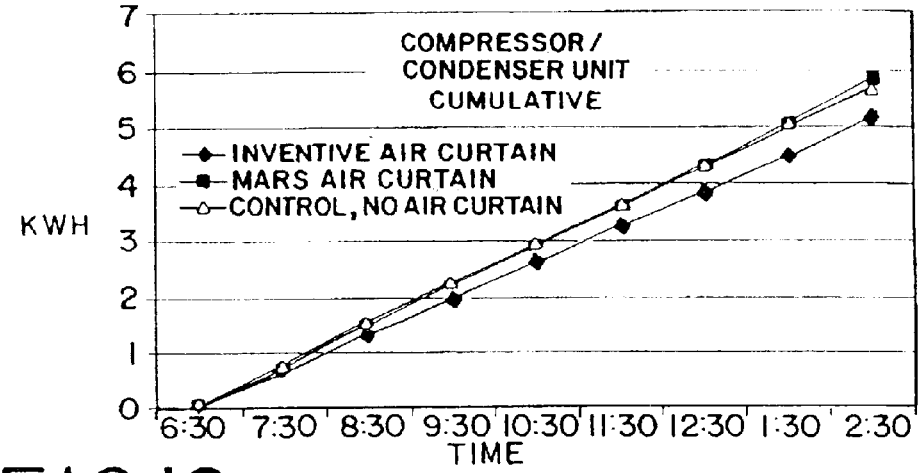
Figure 16:
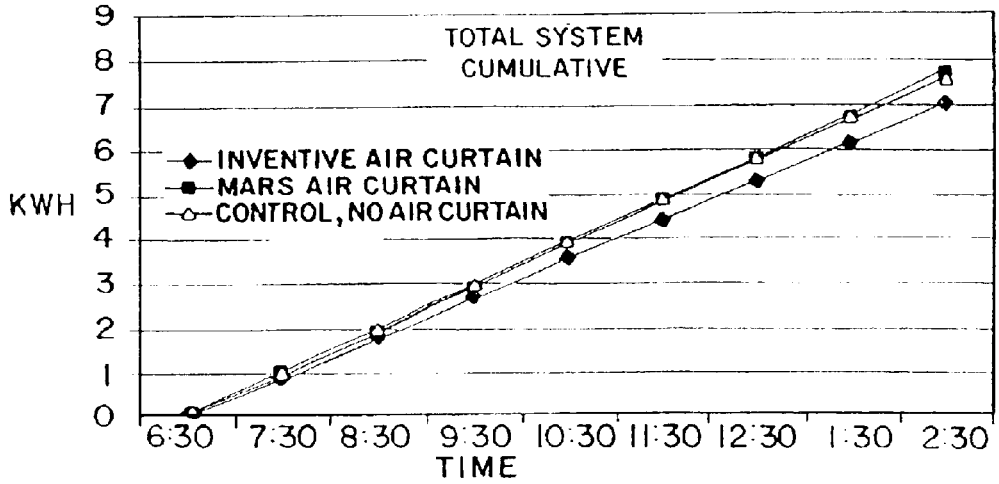

The results are also depicted in FIGS. 14–16. The test showed that the prior art vertical air curtain used more power to operator than it saved in reduced refrigeration system power consumption. The same test showed that the cooler equipped with a preferred inventive horizontal air curtain had 13.2% less run time and consumed 9% less power than an identical cooler equipped with a prior art vertical air curtain. On the other hand, a cooler with no air curtain had 9.7% more run time and used 11% more power than a cooler with the preferred inventive air curtain.

In another series of tests, a cooler in an ambient temperature of 80° F. had an internal set temperature of 35–39° F. The door was opened for 3 minutes at a time, followed by the door being closed for 17 minutes. It was found that power consumption was reduced by 4.5% compared to the same cooler without the air curtain when the cooler was empty. In a preferred embodiment, the air curtain device will reduce power consumption by at least 5%, and more preferably at least 10%, when tested under these conditions. Even greater energy savings are expected at higher ambient temperatures.

The preferred air curtain is far superior in both performance and energy conservation. By adding the preferred air curtain to a walk-in cooler, the energy consumption can be substantially reduced, cutting the overall operating cost and improving the ability to maintain temperature expectation during heavy usage periods. Because the temperature rise is decreased using the present invention, food kept in the cooler will retain better quality. With the preferred air curtain it is easier to meet standards that require the temperature in the cooler to be kept below 40° F. at all times.

The invention has been described in connection with walk-in coolers. However, it is also applicable to reach-in coolers.

It will be appreciated that the preferred embodiments described above are subject to modification without departing from the invention. Therefore it should be understood that the invention is to be defined by the following claims rather than the preferred embodiments described above.

What is claimed is:

1. An apparatus for creating an air curtain for a cooler having a refrigerated compartment, the apparatus comprising:

a) at least one air moving device drawing air in from the refrigerated compartment and emitting said air;

b) at least one motor powering the air moving device;

c) a control system including a sensor detecting whether a door of the cooler is open, the control system providing power to operate the motor when the sensor detects that the door of the cooler is open; and d) one or more air discharge nozzles directing air emitted by the at least one air moving device to create a curtain of air that flows horizontally only across a bottom portion of a doorway of the cooler normally closed by said door, wherein said bottom portion comprises about ¾ or less of the height of the doorway of the cooler, the one or more nozzles being configured to be mounted adjacent to a doorway of the cooler such that air is discharged at an angle of at least 5° in relation to a plane of the doorway.

2. The apparatus of claim 1 wherein the nozzles are configured to be mounted by being attached to a blower housing that has a flat side, with the nozzles being directed to discharge air at an angle of at least 5° in relation to said flat side.

3. The apparatus of claim 1 wherein the sensor comprises an electromechanical switch detecting the opening of the door.

4. The apparatus of claim 1 wherein the one or more air discharge nozzles discharge air at a velocity of at least 200 feet/min.

5. The apparatus of claim 1 wherein the one or more air discharge nozzles discharge air at a velocity of between 500 and 2000 feet/min.

6. The apparatus of claim 1 wherein the at least one air-moving device comprises one or more tangential blowers.

7. The apparatus of claim 1 wherein the at least one air-moving device comprises one or more centrifugal blowers.

8. The apparatus of claim 1 wherein the at least one air-moving device comprises four blowers powered by two dual shaft motors.

9. The apparatus of claim 1 wherein the at least one motor is a permanent split capacitance (PSC) motor.

10. The apparatus of claim 1 wherein the at least one motor is a solid state commutated (SSC) motor.

11. The apparatus of claim 1 wherein the at least one motor is a C-frame motor.

12. The apparatus of claim 1 wherein the at least one motor is a shaded pole motor.

13. The apparatus of claim 1 wherein the at least one motor is a DC motor.

14. The apparatus of claim 1 wherein the at least one motor is a split phase motor.

15. The apparatus of claim 1 wherein the at least one motor can achieve a speed of at least 1000 rpm.

16. The apparatus of claim 1 wherein the at least one motor can achieve a speed of at least 1500 rpm.

17. The apparatus of claim 1 wherein the one or more air discharge nozzles have a rectangular discharge area configuration with a width of between about ½ and 5 inches.

18. The apparatus of claim 1 wherein the one or more air discharge nozzles have a rectangular discharge area configuration with a width of between ¾ and 2 inches.

19. The apparatus of claim 1 wherein the air moving device and the one or more nozzles are designed and positioned to blow air only across the bottom portion comprising between about ⅔ and about ¾ of the height of the doorway of the cooler.

20. The apparatus of claim 1 wherein the control system turns the air moving device on instantaneously when the sensor senses that the door is opened.

21. The apparatus of claim 1 wherein the control system cuts the power to the least one motor when the sensor senses that the door is closed.

22. The apparatus of claim 1 wherein the one or more air discharge nozzles are mounted directly adjacent to the air moving device.

23. The apparatus of claim 1 wherein the one or more air discharge nozzles are configured to be mounted adjacent to a doorway such that air is discharged at an angle of between 5° and 45° in relation to a plane of the doorway.

24. The apparatus of claim 1 wherein the one or more air discharge nozzles are configured to be mounted adjacent to a doorway such that air is discharged at an angle of between 5° and 40° in relation to a plane of the doorway.

25. The apparatus of claim 1 wherein the one or more air discharge nozzles are configured to be mounted adjacent to a doorway such that air is discharged at an angle of between 10° and 38° in relation to a plane of the doorway.

26. The apparatus of claim 1 wherein the one or more air discharge nozzles are configured to be mounted adjacent to a doorway such that air is discharged at an angle of between 15° and 36.5° in relation to a plane of the doorway.

27. The apparatus of claim 1 wherein the one or more air discharge nozzles are configured to be mounted adjacent to a doorway such that air is discharged at an angle of between 20° and 35° in relation to a plane of the doorway.

28. The apparatus of claim 1 wherein the one or more air discharge nozzles are configured to be mounted adjacent to a doorway such that air is discharged at an angle of about 30° in relation to a plane of the doorway.

29. A method of operating a cooler having insulated walls defining a refrigerated compartment, a doorway in one of the walls having a normally closed door, and a refrigeration system cooling the cooler, the method comprising the steps of:

a) starting a motor powering one or more blowers in conjunction with the door being opened;

b) the one or more blowers drawing air from the refrigerated compartment and emitting the air via one or more nozzles to produce a horizontal air curtain when the motor drives the one or more blowers, the one or more nozzles discharging the air at an angle of at least 5° in relation to a plane of the doorway; and c) stopping the motor by cutting off power to the motor in conjunction with the door being closed, d) wherein the horizontal air curtain blows only across a lower portion of the doorway.

30. The method of claim 29 wherein the motor is started as soon as the door is opened.

31. The method of claim 29 wherein the motor is an electric motor and electrical current to the motor is cut off as soon as the door is closed.

32. The method of claim 29 wherein the lower portion of the doorway comprises about ¾ or less of the height of the doorway of the cooler.

33. The method of claim 32 wherein the horizontal air curtain blows across approximately the lower ⅔ to ¾ of the area of the doorway.

34. The method of claim 29 wherein the air curtain reduces the amount of cool air escaping from approximately the lower ⅓ of the area of the doorway compared to a doorway without an air curtain on a cooler operating under the same internal and external temperature conditions.

35. The method of claim 29 wherein the air curtain reduces the amount of warm air entering through approximately the upper ⅓ of the area of the doorway.

36. The method of claim 29 wherein the air is drawn directly into the one or more blowers from the refrigerated compartment.

37. An apparatus mounted inside of a refrigerated compartment of a walk-in cooler for creating a horizontal air curtain for a doorway of the cooler comprising:

a) four 12" long tangential blowers wherein each blower circulates the cool air from within the cooler and operates at a rotation speed of about 1650 RPM, and has a wheel with diameter of about 65 mm.;

b) two 1/25 horsepower dual shaft PSC motors, each motor being positioned between and powering two blowers;

c) an air discharge nozzle mounted adjacent each blower to discharge an air stream at an angle of about 30° from a plane of a doorway of the cooler, the nozzles having a discharge area of rectangular cross section and about 1⅛ inches wide;

d) the nozzles directing the stream of air emitted by the blowers to create a horizontal air curtain that flows only across approximately the lower ¾ of the area of the doorway and inhibiting cold air from escaping approximately the lower ¾ of the doorway of a cooler, the nozzles emitting air at a velocity such that the air still has a velocity of about 250 feet/mm at a far side of the doorway;

e) a control system, including an electro-mechanical switch detecting whether the door of the cooler is open, that turns the blowers on when the sensor senses that the door is open and off when the sensor senses that the door is closed; and f) a safety guard covering the blowers, the motors and the nozzles for protection of people using the cooler.

38. A cooler having a refrigerated compartment defined by insulated walls, a doorway in one of the walls and a door normally closing the doorway, the cooler also comprising an air curtain device comprising:

a) one or more blowers drawing air from the refrigerated compartment and emitting said air;

b) one or more motors powering the one or more blowers;

c) a control system comprising a sensor detecting whether the door of the cooler is open, the control system providing power to operate the one or more motors when the sensor detects that the door is open; and d) one or more air discharge nozzles directing air from the one or more blowers to form a curtain of air that flows horizontally across at least a portion of the doorway only when the door is open and at an angle of at least 5° in relation to a plane of the doorways, e) wherein the curtain of air blows only across a lower portion of the doorway.

39. The cooler of claim 38 wherein the curtain of air reduces the amount of warm air entering the cooler via approximately the upper ¼ of the doorway compared to a doorway without an air curtain on a cooler operating under the same internal and external temperature conditions.

40. The cooler of claim 39 wherein the curtain of air reduces the amount of warm air entering the cooler via approximately the upper ½ of the doorway.

41. The cooler of claim 38 wherein the door is about 34" wide and about 78" tall.

42. The cooler of claim 38 wherein the one or more air discharge nozzles direct the curtain of air at an angle of between about 5° and about 45° in relation to a plane of the doorway.

43. The cooler of claim 38 wherein the one or more blowers comprise at least two blowers mounted adjacent the doorway of the cooler with a vertical axis of rotation.

44. The cooler of claim 38 wherein the sensor comprises an electro-mechanical switch.

45. The cooler of claim 44 wherein the switch forms part of an electrical circuit in the control system and turns power on when the door of the cooler is opened.

46. The cooler of claim 44 wherein the switch forms part of an electrical circuit in the control system and turns power off when the door of the cooler is closed.

47. The cooler of claim 38 wherein the air curtain reduces energy consumption of the cooler by reducing the amount of cold air escaping through the doorway of the cooler when the door is open.

48. The cooler of claim 38 wherein the doorway is wider than 60 inches and the curtain comprises two air streams blowing towards each other.

49. The cooler of claim 38 wherein the air curtain device reduces refrigerated compartment energy consumption by at least 4.5% compared to a cooler that does not include the air curtain device, as measured when the refrigerated compartment is empty, the ambient temperature is 80° and the cooler is set to maintain a temperature of 35°, and when the door is opened periodically for 3 minutes and closed 17 minutes between each time it is opened during an eight hour test period.

50. The cooler of claim 38 wherein the air curtain device reduces the rise in the coolers average temperature when the door is left open for 15 minutes by at least 2.5° F. compared to not using the air curtain device, when tested on an empty refrigerated compartment of about 935 cubic feet.

51. The cooler of claim 38 wherein the one or more blowers are covered with a safety guard for protection of the people using the cooler.

52. The cooler of claim 38 wherein the angle of the one or more air discharges nozzles is not adjustable.

53. The cooler of claim 38 wherein the width of the one or more air discharge nozzles is not adjustable.

54. The cooler of claim 38 wherein the speed of the one or more blowers is not adjustable.

55. The cooler of claim 38 wherein the cooler is a walk-in refrigerator.

56. The cooler of claim 38 wherein the cooler is a walk-in freezer.

57. The cooler of claim 38 wherein said lower portion comprises approximately the lower ¾ area of the doorway.

58. The cooler of claim 38 wherein the one or more nozzles are positioned directly adjacent to the one or more blowers.

59. The cooler of claim 38 wherein the angle of the air curtain emitted from the one or more nozzles serves to balance the convection pressure from temperature differences from inside the cooler to the environment surrounding the cooler.

60. The cooler of claim 38 wherein the one or more nozzles cause the air to spread out at an angle of between about 2° and 15° as it is discharged from the blower.

61. A method of designing an energy efficient cooler comprising:

a) identifying parameters specific to a given cooler design that have a bearing on the characteristics of a horizontal air curtain that will economically inhibit cold air from leaving the cooler when a door to the cooler is open; and b) selecting a blower and an air discharge nozzle, and configuring the blower and nozzle such that i) the volume of air emitted by the blower, ii) the angle of the air discharge nozzle compared to plane of a doorway of the cooler and iii) the velocity of an air stream emitted from the air discharge nozzle are selected to minimize power consumption required to operate the combined cooler and air curtain, wherein the horizontal air curtain blows only across a lower portion of the doorway.

62. The method of claim 61 wherein the width of the discharge nozzle and the velocity of air are chosen to fit a specific door size.

63. The method of claim 61 wherein the angle of the discharge nozzle is designed to ensure that air leaving the nozzle counters the cool air attempting to leave the cooler when the door is open.

64. The method of claim 61 wherein the velocity of air emission is designed to ensure that air leaving the nozzle counters the air attempting to leave the cooler when the door is open.

65. The apparatus of claim 1 wherein the temperature of the air discharged by the one or more nozzles is the same over the height of the air curtain.

66. The apparatus of claim 1 wherein the velocity of the air discharged by the one or more nozzles in emission is substantially the same over the height of the air curtain.

67. The apparatus of claim 1 wherein the angle at which the air discharged by the one or more nozzles is generally uniform over the height of the air curtain.

68. The apparatus of claim 1 wherein the air is drawn directly into the air moving device from the refrigerated compartment.

69. The apparatus of claim 1 wherein the air moving device comprises multiple blowers each mounted so as to have a vertical axis of rotation.

70. The apparatus of claim 1 wherein the air moving device is located in close proximity to the one or more air discharge nozzles such that no duct is disposed between the air moving device and the one or more air discharge nozzles.

71. A compact apparatus for creating a horizontal air curtain for a doorway of a cooler comprising:

a) at least one blower;

b) at least one motor powering the blower;

c) at least one air discharge nozzle;

d) the at least one motor and blower being vertically mounted together in a stacked manner, the at least one blower being mounted directly adjacent to the at least one air discharge nozzle;

e) a sensor detecting whether a door of the cooler is open; and f) a control system that provides power to operate the motor when the sensor detects a door-open condition, g) wherein the horizontal air curtain blows only across a lower portion of the doorway.

72. The apparatus of claim 71 wherein the device has four blowers and two PSC motors, and all the components of the device fit within an assembly having a volume of less than 1 cubic foot.

73. The apparatus of claim 72 wherein the assembly is designed for installation in an existing cooler to retrofit the cooler with a horizontal air curtain.

74. A method of conserving energy during operation of a walk-in cooler comprising the steps of:

a) providing a walk-in cooler having a refrigeration system and insulated walls, with a doorway in one of the walls and a door normally closing the doorway, with a horizontal air curtain apparatus, the air curtain apparatus comprising i) at least one air moving device;

ii) at least one motor powering the air moving device;

iii) a control system that detects when the door is open and provides power to operate the at least one motor only when the door is open; and iv) one or more air discharge nozzles directing air emitted by the at least one air moving device to create a curtain of air that flows horizontally across only a lower portion of the doorway; and b) operating the air curtain apparatus such that the energy consumed to create the air curtain is less than the energy saved as the refrigeration system has to do less work because air flow in and out of the doorway is inhibited by the air curtain when the door is open.

75. The method of claim 74 wherein the walk-in cooler is a walk-in cooler that has previously been used and the method involves retrofitting the cooler by installing the horizontal air curtain apparatus.

* * * * *